US010583961B2

(12) United States Patent
Gosen et al.

(10) Patent No.: US 10,583,961 B2
(45) **Date of Patent: *Mar. 10, 2020**

(54) STORAGE CONTAINER SYSTEMS

(71) Applicant: S.C. Johnson & Son, Inc., Racine, WI (US)

(72) Inventors: Craig R. Gosen, Sanford, MI (US); Katie M. Wazny, Linwood, MI (US); Jeffrey J. Zettle, Bay City, MI (US); Matthew N. Thurin, Wauwatosa, WI (US); David P. Mather, Milwaukee, WI (US); Christopher M. Wlezien, Chicago, IL (US); Saad Chaudry, Skokie, IL (US); Martin Rathgeber, Chicago, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/167,960

(22) Filed: Oct. 23, 2018

(65) Prior Publication Data

US 2019/0055058 A1 Feb. 21, 2019

Related U.S. Application Data

(63) Continuation of application No. 15/594,768, filed on May 15, 2017, now Pat. No. 10,138,020, which is a (Continued)

(51) Int. Cl.
*B65D 23/06* (2006.01)
*B65D 21/02* (2006.01)
(Continued)

(52) U.S. Cl.
CPC ..... *B65D 21/0223* (2013.01); *B65D 21/0204* (2013.01); *B65D 21/0233* (2013.01);
(Continued)

(58) Field of Classification Search
CPC . B65D 21/0233; B65D 21/0219; B65D 23/06
(Continued)

(56) References Cited

U.S. PATENT DOCUMENTS 1,278,695 A 9/1918 Ludwig
1,542,115 A 6/1925 Weis
(Continued)

FOREIGN PATENT DOCUMENTS

GB 4021888 10/2011
JP S48-53874 7/1973
(Continued)

OTHER PUBLICATIONS

English translation of Jan. 23, 2018, Office Action in Japanese Patent Application No. 2017-135510.
(Continued)

*Primary Examiner* — King M Chu

(57) ABSTRACT

A container system includes a first container including a bottom wall, at least one sidewall, and an open top, with a plurality of indented recesses formed in the bottom wall. A first lid closes the open top of the first container. A second container includes a bottom wall, at least one sidewall, and an open top. A second lid closes the open top of the second container, with a push indicator structure formed at a center portion of the second lid, and with a plurality of registration bumps formed about the push indicator structure. The first container is stackable on the second lid such that (i) each of the registration bumps in the second lid is aligned with an adjacent one of the recesses in the bottom wall of the first container and (ii) surfaces of the registration bumps are spaced from surfaces of the adjacent recesses.

14 Claims, 18 Drawing Sheets

Related U.S. Application Data continuation of application No. 14/798,506, filed on Jul. 14, 2015, now Pat. No. 9,682,799, which is a continuation of application No. 13/946,513, filed on Jul. 19, 2013, now Pat. No. 9,108,766.

(51) Int. Cl.

| | |
|---|---|
| ***B65D 41/18*** | (2006.01) |
| ***B65D 43/02*** | (2006.01) |
| *B65D 41/02* | (2006.01) |
| *B65D 41/16* | (2006.01) |

(52) U.S. Cl.

CPC ..... *B65D 41/185* (2013.01); *B65D 43/021* (2013.01); *B65D 21/02* (2013.01); *B65D 21/0201* (2013.01); *B65D 21/0209* (2013.01); *B65D 21/0217* (2013.01); *B65D 41/02* (2013.01); *B65D 41/16* (2013.01); *B65D 41/18* (2013.01); *B65D 43/02* (2013.01); *B65D 43/0202* (2013.01); *B65D 43/0204* (2013.01); *B65D 2543/00027* (2013.01); *B65D 2543/00092* (2013.01); *B65D 2543/00101* (2013.01); *B65D 2543/00555* (2013.01); *B65D 2543/00731* (2013.01)

(58) Field of Classification Search

USPC ..... 220/23.86, 780

See application file for complete search history.

(56) References Cited

U.S. PATENT DOCUMENTS

| | | | |
|---|---|---|---|
| 1,544,972 | A | 7/1925 | Gebelein |
| 1,575,906 | A | 3/1926 | Frey |
| 2,412,325 | A | 12/1946 | Devine et al. |
| 2,575,770 | A | 11/1951 | Roop |
| 2,606,586 | A | 8/1952 | Hill |
| 2,695,115 | A | 11/1954 | Roop |
| 2,944,694 | A | 7/1960 | Kinsey |
| 2,985,354 | A | 5/1961 | Aldington |
| 3,079,037 | A | 2/1963 | Schechter |
| 3,117,692 | A | 1/1964 | Carpenter et al. |
| 3,262,602 | A | 7/1966 | McConnell et al. |
| 3,338,468 | A | 8/1967 | Wilson |
| 3,400,591 | A | 10/1968 | Larson |
| 3,412,888 | A | 11/1968 | Andrews et al. |
| 3,420,397 | A | 1/1969 | Miller |
| 3,452,896 | A | 7/1969 | Elliot |
| 3,498,494 | A | 3/1970 | Voorhees, Jr. |
| 3,589,554 | A | 6/1971 | Smith |
| 3,596,694 | A | 8/1971 | Jaeniche |
| 3,612,342 | A | 10/1971 | Rathbun |
| 3,616,943 | A | 11/1971 | Brink |
| 3,679,088 | A | 7/1972 | Swett et al. |
| 3,692,208 | A | 9/1972 | Croyle et al. |
| 3,719,304 | A | 3/1973 | Douglas |
| 3,743,133 | A | 7/1973 | Rathbun |
| 3,817,420 | A | 6/1974 | Heisler |
| 3,880,288 | A | 4/1975 | Hunter |
| 3,967,731 | A | 7/1976 | Boduch |
| 3,981,401 | A | 9/1976 | Blanchard |
| 4,027,776 | A | 6/1977 | Douglas |
| 4,105,117 | A | 8/1978 | Atkin et al. |
| 4,144,968 | A | 3/1979 | Shelton |
| 4,254,891 | A | 3/1981 | Jeppsson |
| 4,426,014 | A | 1/1984 | Coltman, Jr. |
| 4,446,986 | A | 5/1984 | Bowen et al. |
| 4,471,880 | A | 9/1984 | Taylor et al. |
| 4,474,305 | A | 10/1984 | Marco |
| 4,483,455 | A | 11/1984 | Prophet, Jr. et al. |
| 4,508,768 | A | 4/1985 | Kornely et al. |
| D279,251 | S | 6/1985 | Daenen et al. |
| 4,562,937 | A | 1/1986 | Iyengar |
| 4,679,699 | A | 7/1987 | Malsbury et al. |
| 4,700,842 | A | 10/1987 | Grusin |
| 4,703,857 | A | 11/1987 | Jahnen et al. |
| 4,742,935 | A | 5/1988 | Schellenberg |
| 4,811,860 | A | 3/1989 | Sorenson et al. |
| 4,828,141 | A | 5/1989 | Coy |
| 4,844,263 | A | 7/1989 | Hadtke |
| 4,899,925 | A | 2/1990 | Bowden et al. |
| 4,951,832 | A | 8/1990 | Tenney et al. |
| 5,123,564 | A | 6/1992 | Hobson |
| 5,184,745 | A | 2/1993 | Havens et al. |
| 5,253,781 | A | 10/1993 | Van Melle et al. |
| 5,356,026 | A | 10/1994 | Andress et al. |
| 5,377,860 | A | 1/1995 | Littlejohn et al. |
| 5,409,126 | A | 4/1995 | DeMars |
| 5,419,451 | A | 5/1995 | Bitel, Jr. |
| D360,105 | S | 7/1995 | Doxey |
| 5,472,542 | A | 12/1995 | Wermund |
| 5,507,406 | A | 4/1996 | Urciuoli et al. |
| 5,520,939 | A | 5/1996 | Wells |
| 5,542,234 | A | 8/1996 | Wyslotsky et al. |
| 5,560,315 | A | 10/1996 | Lampe |
| 5,582,317 | A | 12/1996 | Wermund |
| 5,586,656 | A | 12/1996 | Abrums |
| 5,634,559 | A | 6/1997 | Foos et al. |
| D388,325 | S | 12/1997 | Tucker et al. |
| 5,692,617 | A | 12/1997 | Adams |
| 5,709,304 | A | 1/1998 | Credle, Jr. |
| D390,109 | S | 2/1998 | Tucker et al. |
| 5,769,229 | A | 6/1998 | Andress et al. |
| 5,775,483 | A | 7/1998 | Lown et al. |
| 5,799,792 | A | 9/1998 | Abrums |
| 5,810,187 | A | 9/1998 | Woodring |
| 5,881,880 | A | 3/1999 | Jacques et al. |
| D411,741 | S | 6/1999 | Wilson et al. |
| 5,988,420 | A | 11/1999 | Jacques et al. |
| 5,992,679 | A | 11/1999 | Porchia et al. |
| D419,829 | S | 2/2000 | Wilson et al. |
| D420,252 | S | 2/2000 | Loew et al. |
| 6,032,827 | A | 3/2000 | Lettle et al. |
| 6,056,138 | A | 5/2000 | Chen |
| D427,063 | S | 6/2000 | May |
| D428,310 | S | 7/2000 | Zettle et al. |
| 6,158,607 | A | 12/2000 | Wallberg |
| 6,164,484 | A | 12/2000 | Fiore et al. |
| 6,168,044 | B1 | 1/2001 | Zettle et al. |
| 6,170,696 | B1 | 1/2001 | Tucker et al. |
| 6,196,404 | B1 | 3/2001 | Chen |
| D439,744 | S | 4/2001 | Ho |
| D440,470 | S | 4/2001 | Tucker et al. |
| D443,184 | S | 6/2001 | Maxwell et al. |
| D443,798 | S | 6/2001 | Tucker et al. |
| D446,117 | S | 8/2001 | Conti |
| D447,382 | S | 9/2001 | Tucker et al. |
| D448,606 | S | 10/2001 | Conti |
| D448,969 | S | 10/2001 | Conti |
| D449,495 | S | 10/2001 | Tucker et al. |
| D450,983 | S | 11/2001 | Tucker et al. |
| D451,769 | S | 12/2001 | Stanos et al. |
| 6,349,843 | B1 | 2/2002 | Mittmann et al. |
| 6,415,945 | B1 | 7/2002 | Zank et al. |
| D462,880 | S | 9/2002 | Maxwell et al. |
| 6,467,647 | B1 | 10/2002 | Tucker et al. |
| D465,382 | S | 11/2002 | Wolf et al. |
| D466,364 | S | 12/2002 | Demore |
| D472,774 | S | 4/2003 | Pelstring et al. |
| 6,557,720 | B2 | 5/2003 | Tosdale et al. |
| D484,797 | S | 1/2004 | Kipperman et al. |
| D485,468 | S | 1/2004 | Roth et al. |
| D485,473 | S | 1/2004 | Dais et al. |
| 6,672,473 | B2 | 1/2004 | Torniainen et al. |
| 6,685,049 | B1 | 2/2004 | Paladino |
| D488,030 | S | 4/2004 | Drzymala |
| D490,278 | S | 5/2004 | Welsh |
| 6,729,472 | B2 | 5/2004 | Stucke et al. |
| 6,761,041 | B2 | 7/2004 | Roth et al. |
| 6,789,393 | B2 | 9/2004 | Dais et al. |
| 6,796,430 | B2 | 9/2004 | Mercier et al. |
| 6,874,650 | B2 | 4/2005 | Welsh et al. |
| 6,886,694 | B2 | 5/2005 | McNeeley et al. |

(56) References Cited

U.S. PATENT DOCUMENTS

| | | | |
|---|---|---|---|
| D505,835 | S | 6/2005 | Schultz et al. |
| D505,839 | S | 6/2005 | Stanos et al. |
| D505,840 | S | 6/2005 | Schultz et al. |
| D506,106 | S | 6/2005 | Ordiway et al. |
| D506,359 | S | 6/2005 | Zettle et al. |
| D507,155 | S | 6/2005 | Gosen et al. |
| 6,910,599 | B2 | 6/2005 | Tucker et al. |
| D507,937 | S | 8/2005 | Dais et al. |
| D508,187 | S | 8/2005 | Dais et al. |
| D508,188 | S | 8/2005 | Zettle et al. |
| 6,923,017 | B2 | 8/2005 | Dais et al. |
| D511,435 | S | 11/2005 | Roth et al. |
| D512,278 | S | 12/2005 | Schultz et al. |
| D514,390 | S | 2/2006 | Palder |
| D516,859 | S | 3/2006 | Zettle et al. |
| 7,017,775 | B2 | 3/2006 | Zettle et al. |
| 7,032,773 | B2 | 4/2006 | Dees et al. |
| D522,319 | S | 6/2006 | Palder |
| 7,063,231 | B2 | 6/2006 | Stenos et al. |
| D526,161 | S | 8/2006 | Roth et al. |
| D527,244 | S | 8/2006 | Roth et al. |
| 7,097,063 | B2 | 8/2006 | Tucker et al. |
| 7,097,066 | B2 | 8/2006 | Tucker et al. |
| D527,951 | S | 9/2006 | Roth et al. |
| D527,952 | S | 9/2006 | Roth et al. |
| D527,954 | S | 9/2006 | Roth |
| D536,922 | S | 2/2007 | Roth et al. |
| D536,923 | S | 2/2007 | Roth et al. |
| D542,100 | S | 5/2007 | Kim |
| 7,216,769 | B2 | 5/2007 | Palder |
| D545,618 | S | 7/2007 | Zettle et al. |
| D547,177 | S | 7/2007 | Sherman et al. |
| D548,538 | S | 8/2007 | Liu |
| 7,252,196 | B1 | 8/2007 | Koefelda et al. |
| 7,261,219 | B2 | 8/2007 | Tucker et al. |
| D551,496 | S | 9/2007 | Ablo et al. |
| 7,264,135 | B2 | 9/2007 | Savicki et al. |
| D555,475 | S | 11/2007 | Enriquez et al. |
| D556,517 | S | 12/2007 | Lown et al. |
| 7,347,327 | B2 | 3/2008 | Lobman et al. |
| 7,357,272 | B2 | 4/2008 | Maxwell |
| D568,693 | S | 5/2008 | Furlong |
| D568,694 | S | 5/2008 | Furlong |
| D569,722 | S | 5/2008 | Stamper et al. |
| 7,380,412 | B2 | 6/2008 | Roth et al. |
| 7,392,907 | B2 | 7/2008 | Herbert et al. |
| D575,100 | S | 8/2008 | Liu |
| 7,451,875 | B1 | 11/2008 | Norris |
| D585,699 | S | 2/2009 | Furlong |
| D586,179 | S | 2/2009 | Furlong |
| 7,484,639 | B2 | 2/2009 | Maravich et al. |
| D588,417 | S | 3/2009 | Doliwa |
| 7,510,096 | B2 | 3/2009 | Wang |
| D589,759 | S | 4/2009 | Ozery et al. |
| D593,751 | S | 6/2009 | McDade |
| D593,855 | S | 6/2009 | Scheve |
| 7,549,540 | B2 | 6/2009 | Lee et al. |
| D603,697 | S | 11/2009 | Edwards et al. |
| D606,812 | S | 12/2009 | Wu |
| 7,631,776 | B2 | 12/2009 | Vovan et al. |
| 7,661,528 | B2 | 2/2010 | Vovan et al. |
| D611,807 | S | 3/2010 | Miga, Jr. |
| D613,111 | S | 4/2010 | Furlong |
| D615,349 | S | 5/2010 | Furlong |
| 7,721,891 | B2 | 5/2010 | Dubois |
| D618,516 | S | 6/2010 | DiPietro et al. |
| 7,726,483 | B2 | 6/2010 | Ramanujam et al. |
| 7,735,674 | B2 | 6/2010 | Cai |
| 7,866,502 | B2 | 1/2011 | Maxwell |
| D642,861 | S | 8/2011 | Samartgis |
| 8,006,513 | B2 | 8/2011 | Roth et al. |
| 8,011,205 | B2 | 9/2011 | Roth et al. |
| 8,028,851 | B2 | 10/2011 | Vonvan et al. |
| 8,074,830 | B2 | 12/2011 | Pomfrey |
| 8,083,084 | B2 | 12/2011 | Vovan |
| 8,083,095 | B2 | 12/2011 | Hui |
| 8,091,732 | B2 | 1/2012 | Bryson et al. |
| 8,118,190 | B2 | 2/2012 | Coonce |
| 8,123,064 | B2 | 2/2012 | Vovan |
| 8,123,067 | B2 | 2/2012 | Thomson |
| D657,204 | S | 4/2012 | Seehoff et al. |
| 8,146,766 | B2 | 4/2012 | Vovan et al. |
| 8,157,123 | B2 | 4/2012 | Tucker et al. |
| 8,267,278 | B2 | 9/2012 | Tucker et al. |
| 8,308,021 | B2 | 11/2012 | Turvey et al. |
| 8,322,530 | B2 | 12/2012 | Furlong |
| 8,381,909 | B2 | 2/2013 | Hernandez et al. |
| D677,568 | S | 3/2013 | Sina |
| 8,490,810 | B2 | 7/2013 | Lown |
| 8,523,000 | B2 | 9/2013 | Vovan |
| 8,777,043 | B2 | 7/2014 | Furlong |
| 8,777,052 | B2 | 7/2014 | De Jesus |
| D719,399 | S | 12/2014 | Thurin et al. |
| D720,178 | S | 12/2014 | Thurin et al. |
| D721,246 | S | 1/2015 | Thurin et al. |
| D723,340 | S | 3/2015 | Maxwell et al. |
| D723,864 | S | 3/2015 | Thurin et al. |
| D723,914 | S | 3/2015 | Singh et al. |
| D724,891 | S | 3/2015 | Capraro et al. |
| D725,433 | S | 3/2015 | Singh et al. |
| 8,967,416 | B2 | 3/2015 | Furlong |
| D741,170 | S | 10/2015 | Thurin et al. |
| D741,171 | S | 10/2015 | Thurin et al. |
| D741,708 | S | 10/2015 | Thurin et al. |
| D742,224 | S | 11/2015 | Thurin et al. |
| D742,743 | S | 11/2015 | Thurin et al. |
| D744,336 | S | 12/2015 | Thurin et al. |
| D750,483 | S | 3/2016 | Thurin et al. |
| D752,973 | S | 4/2016 | Thurin et al. |
| 9,340,330 | B2 | 5/2016 | LeBoeuf et al. |
| 9,366,468 | B2 | 6/2016 | Roth et al. |
| 9,474,420 | B2 | 10/2016 | Oakes et al. |
| 2001/0035418 | A1 | 11/2001 | Tosdale et al. |
| 2002/0148845 | A1 | 10/2002 | Zettle et al. |
| 2004/0144781 | A1 | 7/2004 | Dees et al. |
| 2006/0011626 | A1 | 1/2006 | Palder |
| 2006/0070907 | A1 | 4/2006 | O'Shea |
| 2006/0261065 | A1 | 11/2006 | Claypool et al. |
| 2007/0119743 | A1* | 5/2007 | Tucker ..... B65D 21/0219 206/503 |
| 2007/0187277 | A1 | 8/2007 | Furlong |
| 2008/0000795 | A1 | 1/2008 | Deakin et al. |
| 2008/0105630 | A1 | 5/2008 | Lown |
| 2009/0084796 | A1 | 4/2009 | Coonce et al. |
| 2009/0145797 | A1 | 6/2009 | Steinmeyer |
| 2009/0173656 | A1 | 7/2009 | Furlong |
| 2010/0006467 | A1 | 1/2010 | Joseph et al. |
| 2010/0065461 | A1 | 3/2010 | Chhay |
| 2010/0108705 | A1 | 5/2010 | De Jesus |
| 2010/0170824 | A1 | 7/2010 | Ramanujam et al. |
| 2010/0176022 | A1 | 7/2010 | Furlong |
| 2010/0181323 | A1 | 7/2010 | Thaler et al. |
| 2010/0200588 | A1 | 8/2010 | Bergman et al. |
| 2010/0236965 | A1 | 9/2010 | Hernandez et al. |
| 2011/0031153 | A1 | 2/2011 | Vovan |
| 2011/0114638 | A1 | 5/2011 | Kettner et al. |
| 2011/0309075 | A1 | 12/2011 | Roth et al. |
| 2011/0315702 | A1 | 12/2011 | LeBoeuf et al. |
| 2012/0006837 | A1 | 1/2012 | Becklin |
| 2012/0048874 | A1* | 3/2012 | Oakes ..... A47J 47/14 220/839 |

FOREIGN PATENT DOCUMENTS

| | | | |
|---|---|---|---|
| JP | S53-3752 | | 6/1976 |
| JP | 2001-048174 | A | 2/2001 |
| JP | 2004-075123 | A | 3/2004 |
| JP | 2005-520111 | A | 7/2005 |
| JP | 2005-253549 | A | 9/2005 |
| JP | 2008-531412 | A | 8/2008 |
| JP | 2009-062073 | A | 3/2009 |
| JP | 4364561 | B2 | 11/2009 |

(56) References Cited

FOREIGN PATENT DOCUMENTS

| | | | |
|---|---|---|---|
| JP | 5020413 | B1 | 9/2012 |
| WO | 2012/009035 | A1 | 1/2012 |

OTHER PUBLICATIONS

Japanese Official Action dated Aug. 29, 2017, issued in corresponding Japanese Patent Application No. 2016-118757, with an English translation.
Japanese Official Action dated Aug. 29, 2017, issued in corresponding Japanese Patent Application No. 2017-135510, with an English translation.
Infantino Annabel Karmel Feeding Accessories, http://www.thanksmailcarrier.com/2010/11/infantino-annabel-karmel-feeding.html (Accessed Jan. 25, 2013).
LunchBlox™ Sandwich Kit, http://www.rubbermaid.com/category/pages/proudctdetail.aspx?Prod_ID=RP092026 (Accessed Jan. 25, 2013).
Pay with Your Food: Lego Bento Box, http://kawaii-fabric.com/tag/fun-bento-boxes/ (Accessed Jan. 25, 2013).
Stackable Lego Takeout Containers, http://inhabitat.com/stackable-lego-takeout-containers-by-takeshi-miyakawa/ (Accessed Jan. 25, 2013).
Set of 5 Stackable Containers, http://www.etsy.com/listing/50125726/set-5-of-stackable-containers (Accessed Jan. 25, 2013).
English translation of Japanese Official Action dated Sep. 8, 2016, issued in corresponding Japanese Patent Application No. 2016-8893.

* cited by examiner

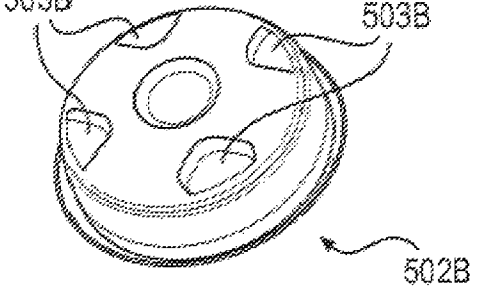
FIG. 8A
FIG. 8B
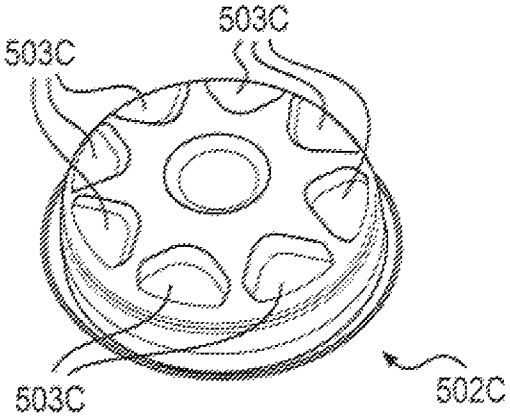
FIG. 8C
FIG. 8D
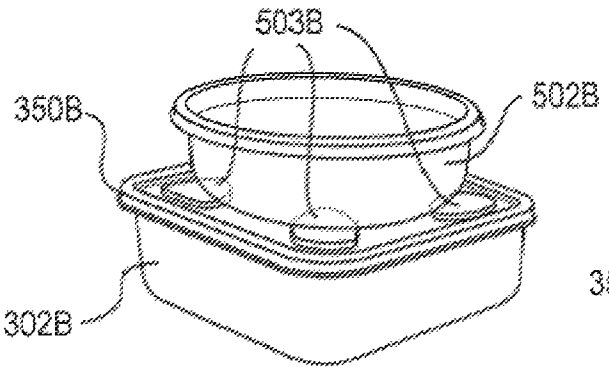
FIG. 8E
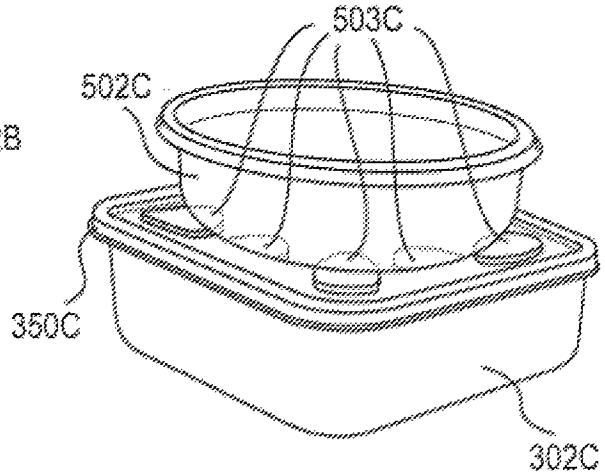
FIG. 8F

STORAGE CONTAINER SYSTEMS

CROSS REFERENCE TO RELATED APPLICATIONS

This application is a continuation of U.S. patent application Ser. No. 15/594,768, filed May 15, 2017, now U.S. Pat. No. 10,138,020, issued Nov. 27, 2018, which is a continuation of U.S. patent application Ser. No. 14/798,506, filed Jul. 14, 2015, now U.S. Pat. No. 9,682,799, issued Jun. 20, 2017, which is a continuation of U.S. patent application Ser. No. 13/946,513, filed Jul. 19, 2013, now U.S. Pat. No. 9,108,766, issued Aug. 18, 2015, each of which is incorporated herein by reference in their entirety.

FIELD OF THE INVENTION

Our invention relates to storage container systems. More specifically, our invention relates to storage container systems that include a plurality of containers and lids, with the lids being capable of sealing the containers, and with sealed containers being stackable in compact arrangements.

RELATED ART

Plastic storage container systems have a wide variety of uses around a home. For example, plastic containers are often used to store food in a refrigerator or a cupboard. Plastic containers may also be used to store other things around the house, for example, small items in closets or tools in garages. In order to take up as little room as possible, container systems are often configured such that the sealed containers can stack on top of each other. In particular, the lids for the containers sometimes have special shapes or structures that enable the lids to be locked to the bottom of another container, thereby providing two containers locked together in a stacked arrangement. Further, the containers and/or lids of plastic container systems are also often configured to nest into each other when the containers are not sealed with lids and when the containers are not filled with items. This decreases the space that is required to store the containers and lids when they are not in use.

While container systems have been made to stack and/or to nest, most such container systems do not provide a plurality of different sized containers that can be stacked or nested together in a convenient and compact arrangements. Additionally, the locking arrangement between containers and lids in some stacking container systems can make it difficult to assemble or to disassemble the system in the stacked arrangement. This problem may be particularly acute when it is desired to remove just one of a plurality of stacked containers from a confined space such as a refrigerator. For example, if the top container of a stack is locked to the lid of another container below that top container, it can be difficult to disengage the top container from the stack when the stack is in a confined space.

With respect to the lids of the containers, it is often important that the lids create a tight seal against the containers so as to prevent, as much as possible, air from entering the containers. At the same time, it is also important that a user can easily form the seal with the lids, otherwise the user may inadvertently not fully seal the container, and the contents of the containers may spoil or be spilled. Thus, many different configurations of lids have been developed for sealing against plastic containers. Nevertheless, it is still relatively difficult for a user to effectively seal the lids against containers in many systems.

SUMMARY OF THE INVENTION

According to one aspect, our invention provides a container system. The container system includes a first container including a bottom wall, at least one sidewall, and an open top, with a plurality of indented recesses being formed in the bottom wall, a first lid configured to close the open top of the first container, a second container including a bottom wall, at least one sidewall, and an open top, and a second lid configured to close the open top of the second container, with a push indicator structure being formed at a center portion of the second lid, and with a plurality of registration bumps being formed about the push indicator structure. The first container is stackable on the second lid such that (i) each of the registration bumps in the second lid is aligned with an adjacent one of the recesses in the bottom wall of the first container and (ii) surfaces of the registration bumps are spaced from surfaces of the adjacent recesses.

According to another aspect, our invention provides a container system. The container system includes a first container including a bottom wall, at least one sidewall, and an open top, with an indented recess being formed in the bottom wall, a first lid configured to close the open top of the first container, a second container including a bottom wall, at least one sidewall, and an open top, and a second lid configured to close the open top of the second container, with a push indicator structure being formed at a center portion of the second lid, and with a plurality of registration bumps being formed about the push indicator structure. The first container is stackable on the second lid such that (i) each of the registration bumps of the second lid is aligned with an adjacent surface of the indented recess in the bottom wall of the first container and (ii) surfaces of the registration bumps are spaced from the adjacent surfaces of the recess, and the first container and the second container have different dimensions.

According to a further aspect, our invention provides a container system. The container system includes a container having a bottom wall, at least one sidewall, and an open top, with a rim extending from the at least one side wall adjacent to the open top, the rim including (i) a first surface extending outward from the at least one side wall and (ii) a second surface extending in a different direction than does the first surface. A lid is provided for sealing the open top of the container, with the lid including a first sealing portion for contacting an area of the inner surface of the at least one side wall and a second sealing portion contacting an area of the first surface of the rim. A tangent to the points of contact of the first sealing portion of the lid and the at least one sidewall and a tangent to the points of contact of the second sealing portion and the first surface of the rim cross at a point that is (i) above the container and (ii) within a projection of the extent of the at least one side wall of the container. When the lid seals the open top of the container, the first and second sealing portions of the lid contact the container and all of the other portions of the lid are spaced from the container.

According to still another aspect, our invention provides a container system that includes a container including a bottom wall, a plurality of sidewalls, and an open top, with an indented recess being formed in the bottom wall, and a lid configured to close the open top of the first container, with a push indicator structure being formed at a center portion of the lid, and with at least one registration bump being formed in the lid. A total surface area of the at least one registration bump is greater than a spatial area of the lid that is calculated as the length of the lid multiplied by the width of the lid.

BRIEF DESCRIPTION OF THE DRAWINGS

FIGS. 8A-8F are views of container systems according to another embodiment of our invention.

DETAILED DESCRIPTION OF THE INVENTION

Figure 1A:
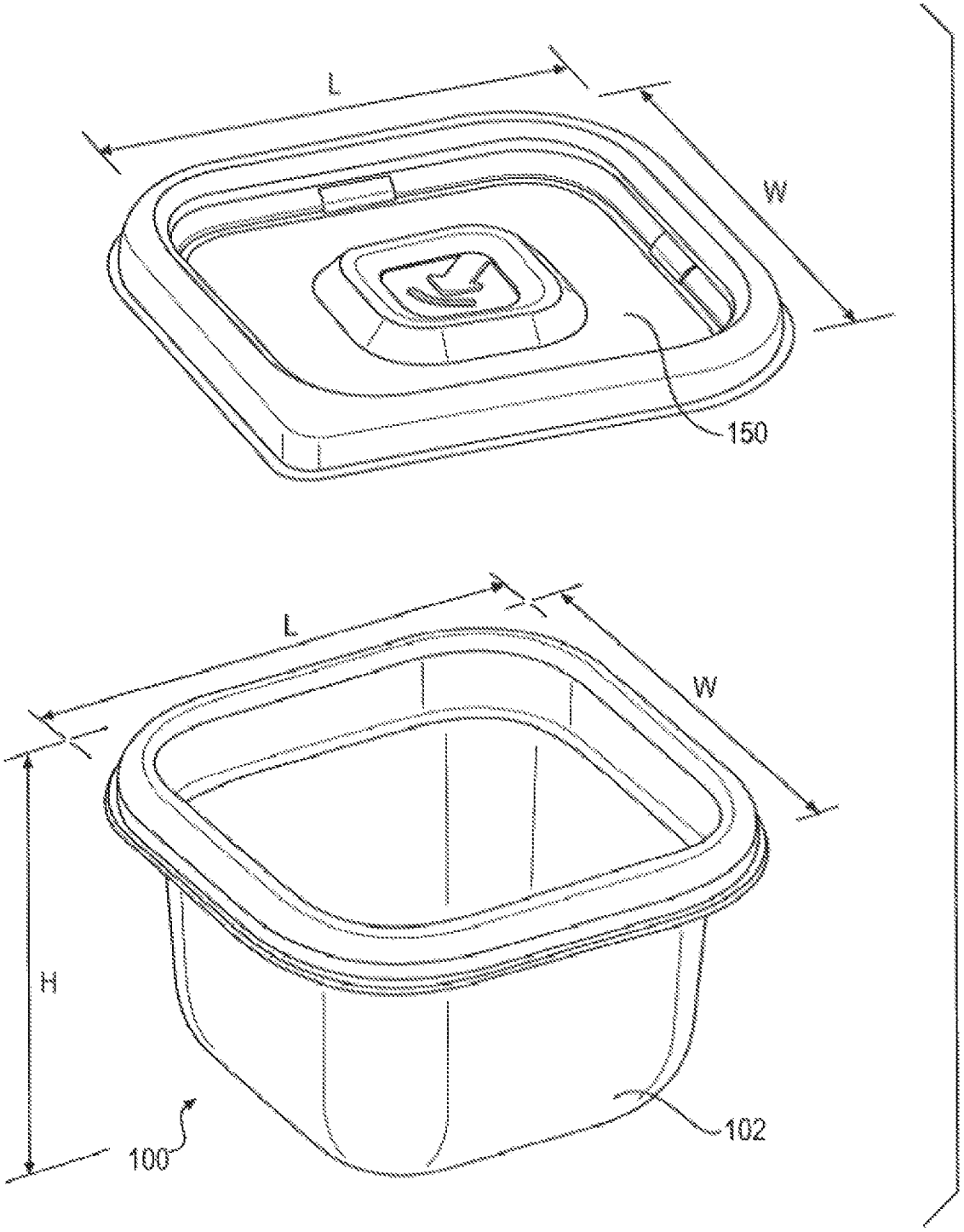
FIGS. 1A-1E are elevation views of a container system including a plurality of containers and lids according to an embodiment of our invention.
Figure 1B:
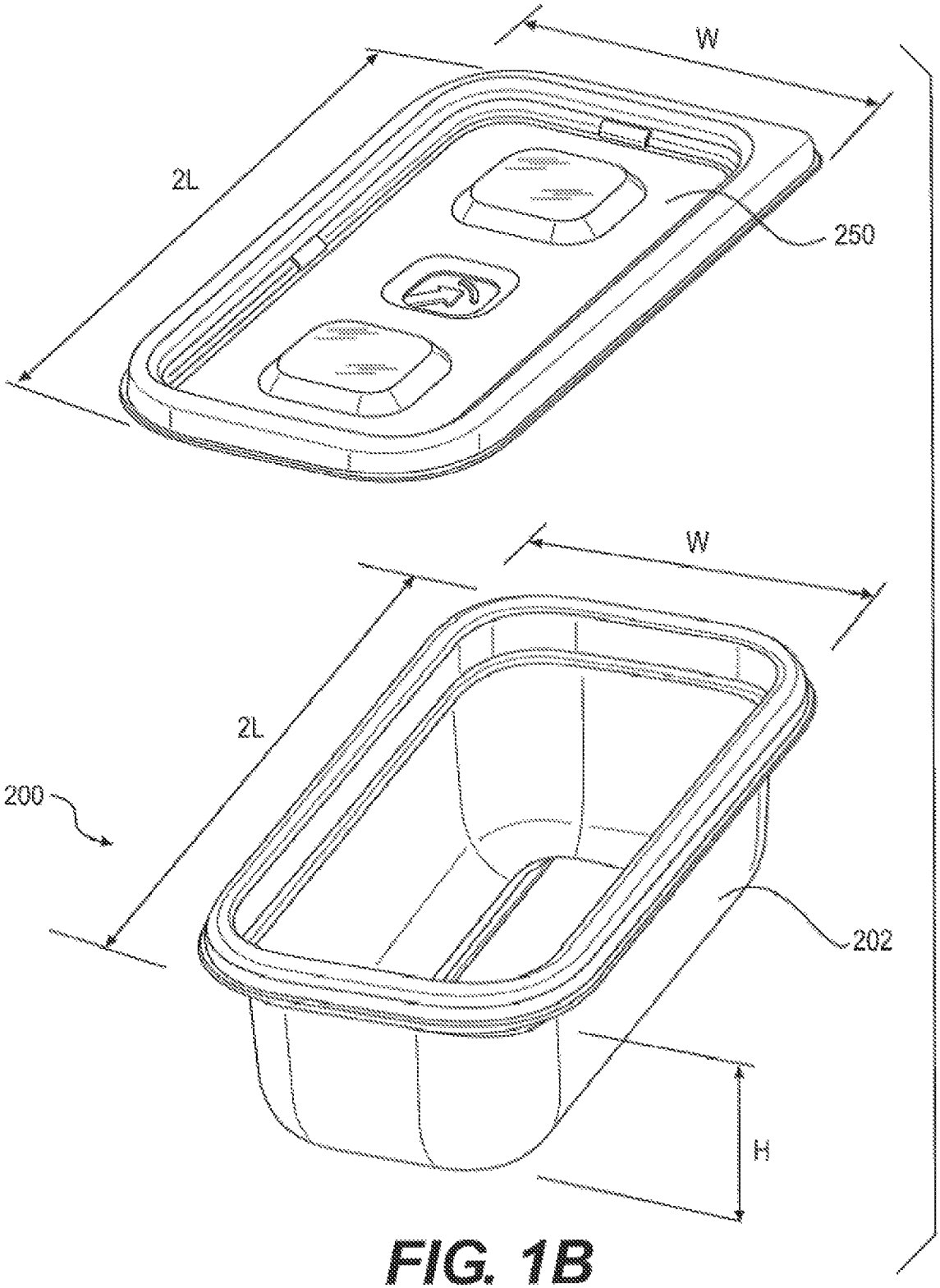
Figure 1C:
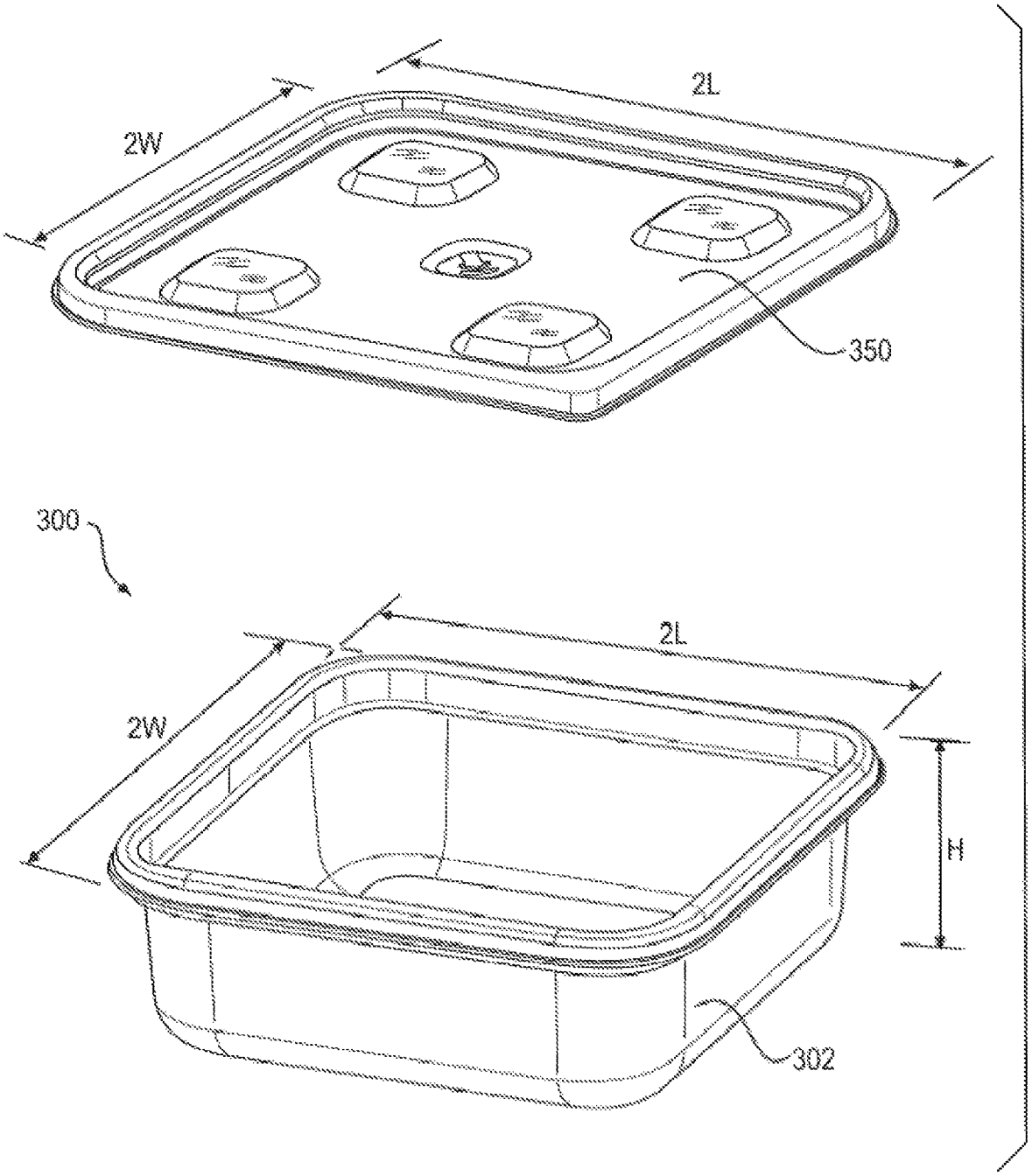
Figure 1D:
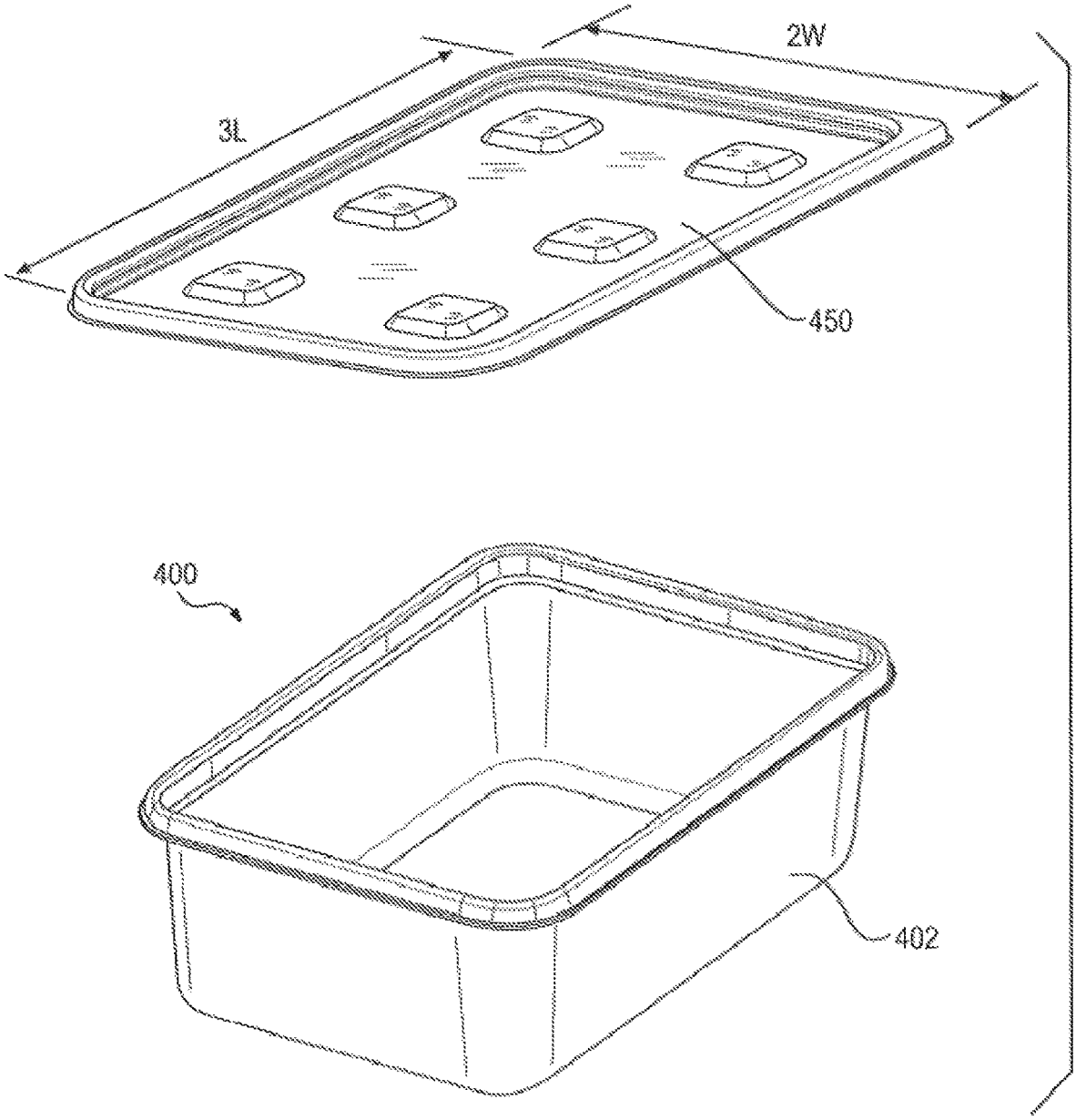
Figure 1E:
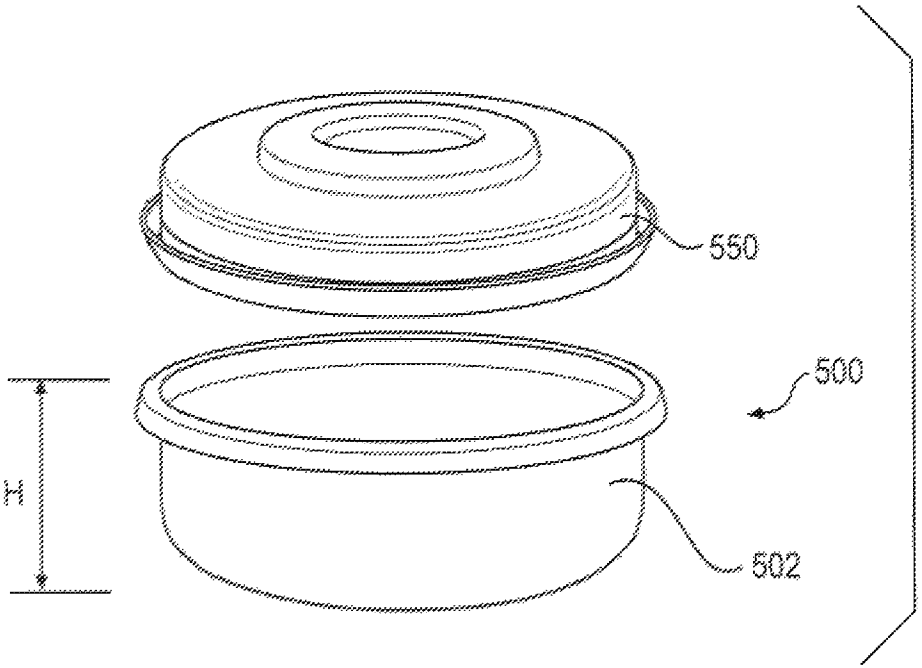

Our invention relates to container systems that include containers and corresponding lids for sealing the containers. The containers and lids can be made from a variety of materials, and in particular, a wide variety of plastics. The containers can be used to store many different items, including liquid and solid food products.

FIGS. 1A-1E are views of five container and lid combinations 100, 200, 300, 400, and 500 according to an embodiment of our invention. The combinations 100, 200, 300, 400, and 500 include containers 102, 202, 302, 402, and 502, and lids 150, 250, 350, 450, and 550. The containers 102, 202, 302, and 402, have generally rectangular shapes, and the container 502 has a generally round shape. It will be recognized from the disclosure herein, however, that the containers according to our invention could be formed in different shapes, and, thus, are not limited to the depicted rectangular or round shapes.

The container and lid combinations 100, 200, 300, and 400 are modular in the sense that the combinations 100, 200, 300, and 400 have lengths and widths that are proportional to each other. More specifically, when the length and width of container 102 and lid 150 are designated as 1L and 1W, respectively, then the other containers 202, 302, and 402 and lids 250, 350, and 450 have lengths and widths that are about aL and bW, where a and b are integers. For example, the container 202 can have a length of about 2L and a width of about W, the container 302 can have a length 2L and a width 2W, and the container 402 can have a length 3L and a width 2W, and container 402 can have a length 3W and a width 2L. Although the round combination 500 does not have a defined length and width, the round container 502 is consistent with the modularity of the other combinations 100, 200, 300, and 400 inasmuch as it can be stacked in compact arrangements with the other combinations 100, 200, 300, and 400, as will be described below.

There are no specific limitations on the sizes of the containers 102, 202, 302, 402, and 502 and lids 150, 250, 350, 450, and 550, but rather the dimensions can be selected for particular applications. For example, when the rectangular containers 102, 202, 302, and 402 are intended to be used to store food, the length and width of the smallest container 102 can be selected for storing a particular product such as a sandwich. In such a case, the length and width of container 102 would be made slightly larger than the size of an ordinary piece of bread. In other embodiments, the container 302 with a 2L length and a 2W width can be sized for storing a sandwich. Given the modular functionality of the combinations 100, 200, 300, 400, and 500, once the length and width are selected for any one of the containers 102, 202, 302, 402, and 502, the lengths and widths of the other containers can be determined based on the proportionality described above. It should be noted, however, that while the sizes of the containers 102, 202, 302, 402, and 502 may be generally proportional, it is not a requirement that the dimensions fall into exact ratios. As will be appreciated by those skilled in the art, the modular functionality of the container systems described herein can be achieved even if the dimensions of the containers vary slightly from exact ratios. In this regard, the proportionality of the lengths and widths, as indicated herein by 1L, 1W, 2L, 2W, etc., should be viewed as approximate and satisfied as long as the modularity functionality described herein is achieved. It should also be noted that numerous other container systems with different dimensions can be provided in addition to those shown in FIGS. 1A-1E. For example, a container having a 3L length and a 3W width could be provided in a system of containers according to our invention.

There are no particular requirements or limitations for the height dimension of the containers 102, 202, 302, 402, and 502. In the embodiment depicted in FIGS. 1A-1E, the containers 102, 202, 302, 402, and 502 all have approximately the same height H. In other embodiments, however, any one of containers 102, 202, 302, 402, and 502 could have a different height while still fitting within the modularity of the systems described herein.

Figure 2A:
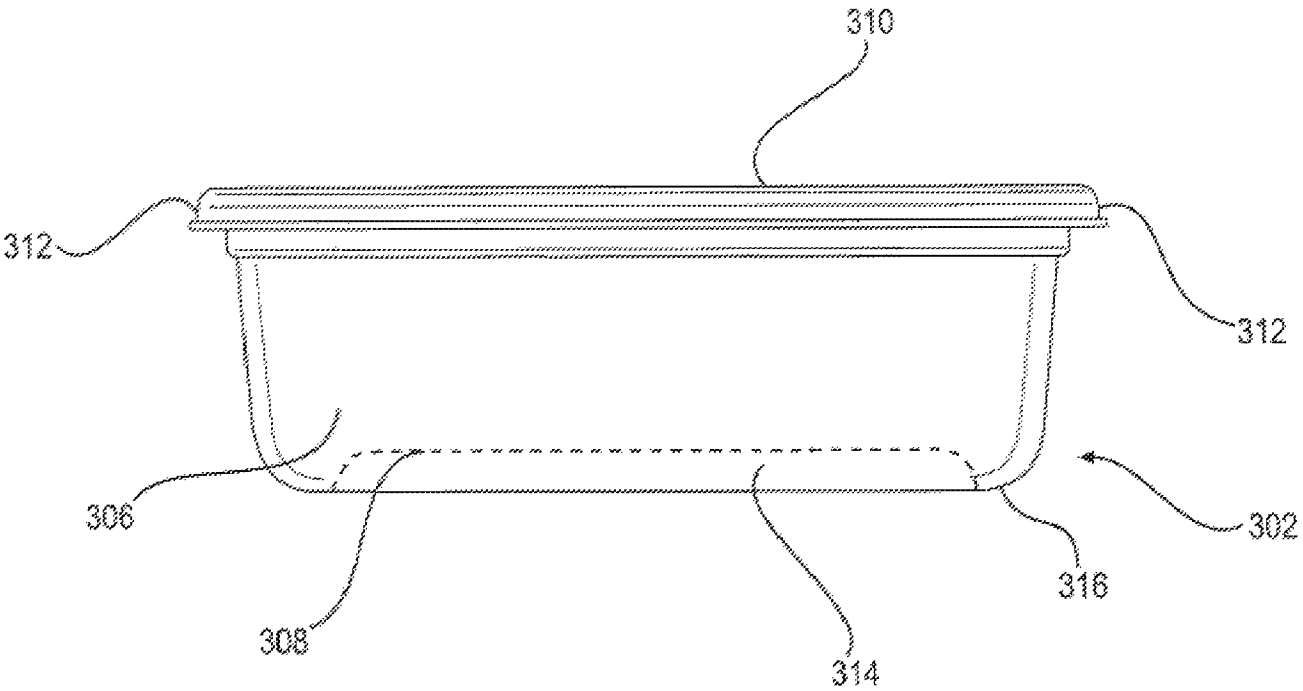
FIGS. 2A-2C are views of one of the containers shown in FIG. 1.
Figure 2B:
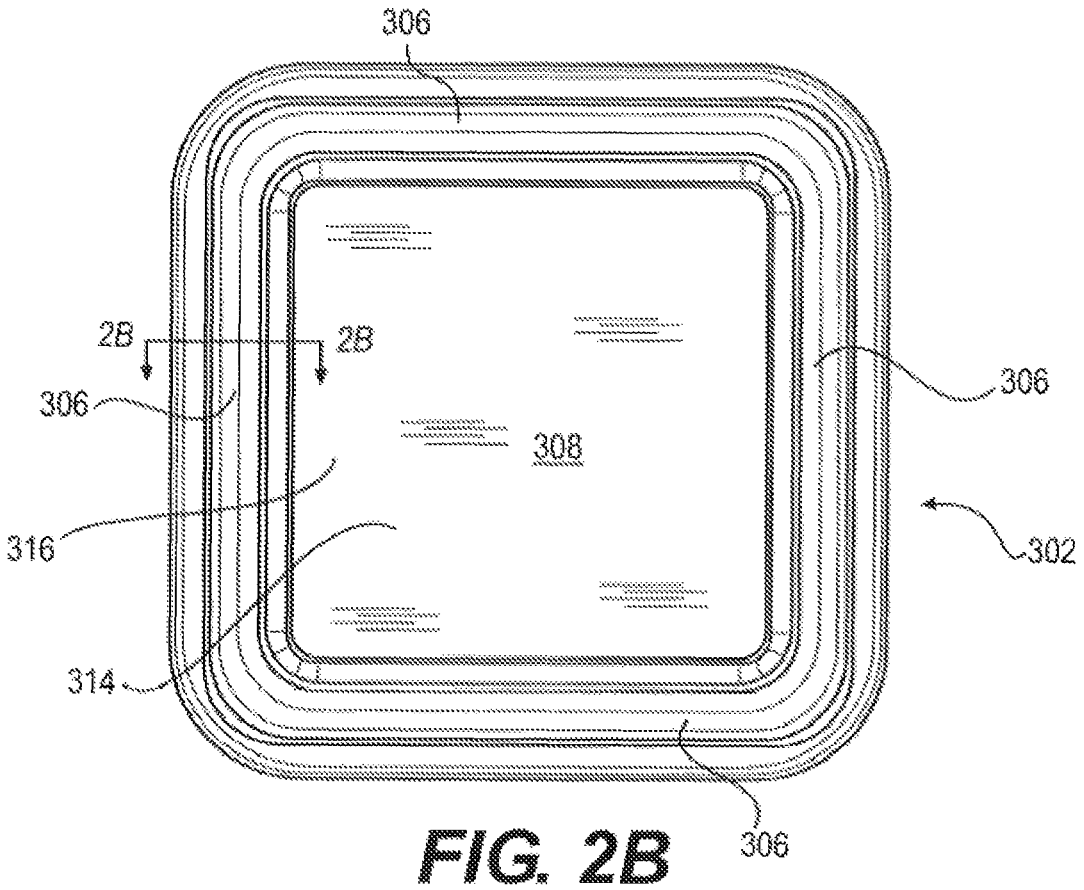
Figure 2C:
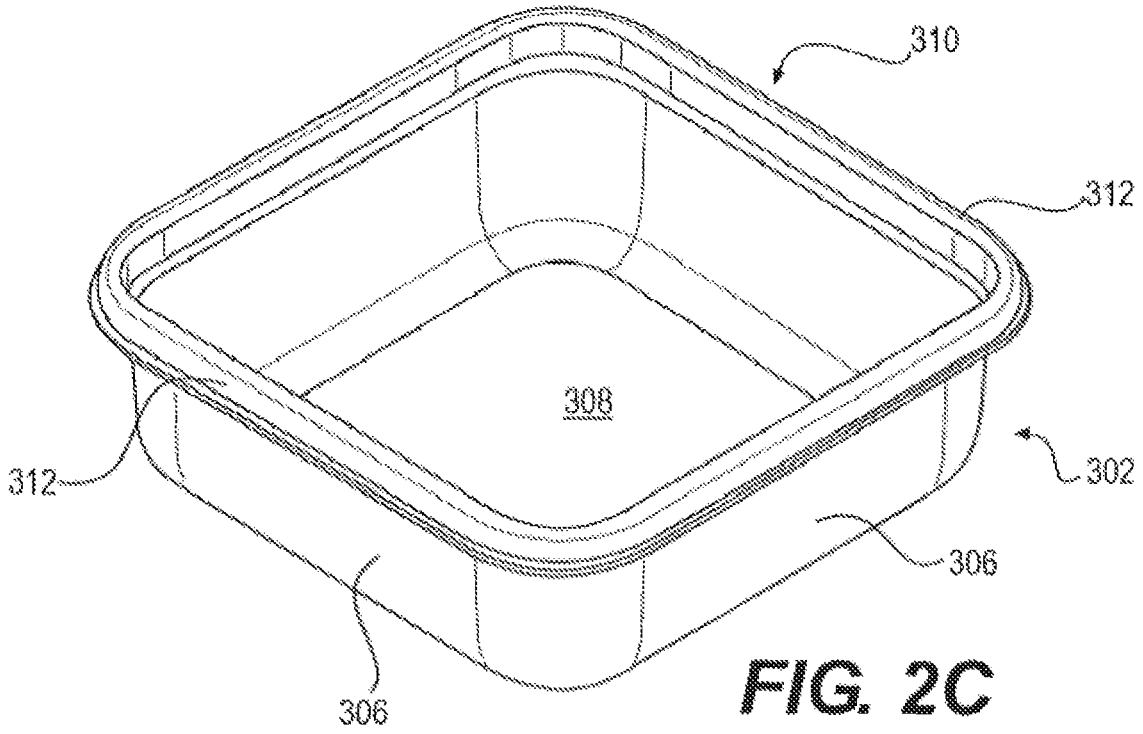

FIGS. 2A-2C are views of the container 302, which includes a plurality of sidewalls 306 and a bottom wall 308. The container 302 also includes an open top 310. At the top of the sidewalls 306 and surrounding the open top 310 is a sealing rim 312. The sealing rim 312 is engaged by the lid 304 to seal the container 302, as will be described in detail below. The bottom wall 308 includes an indented recess 314 that is surrounded by a foot region 316. The indented recess 314 is configured to align with registration bumps that are provided on the lid of one or more additional container, as will be described in detail below.

The configuration of container 302 with the foot region 316 surrounding the indented recess 314 provides a relatively level and stable surface at the bottom of the container 302. As will be described below, the recess 314 can be relatively shallow and need not extend deeply into the interior of the container 302. As will be appreciated by those skilled in the art, problems that may arise with other container bottom configurations, such as rocker bottoms or inadvertent doming in the recessed region, can be lessened using the configuration of containers according to our invention.

Figure 3A:
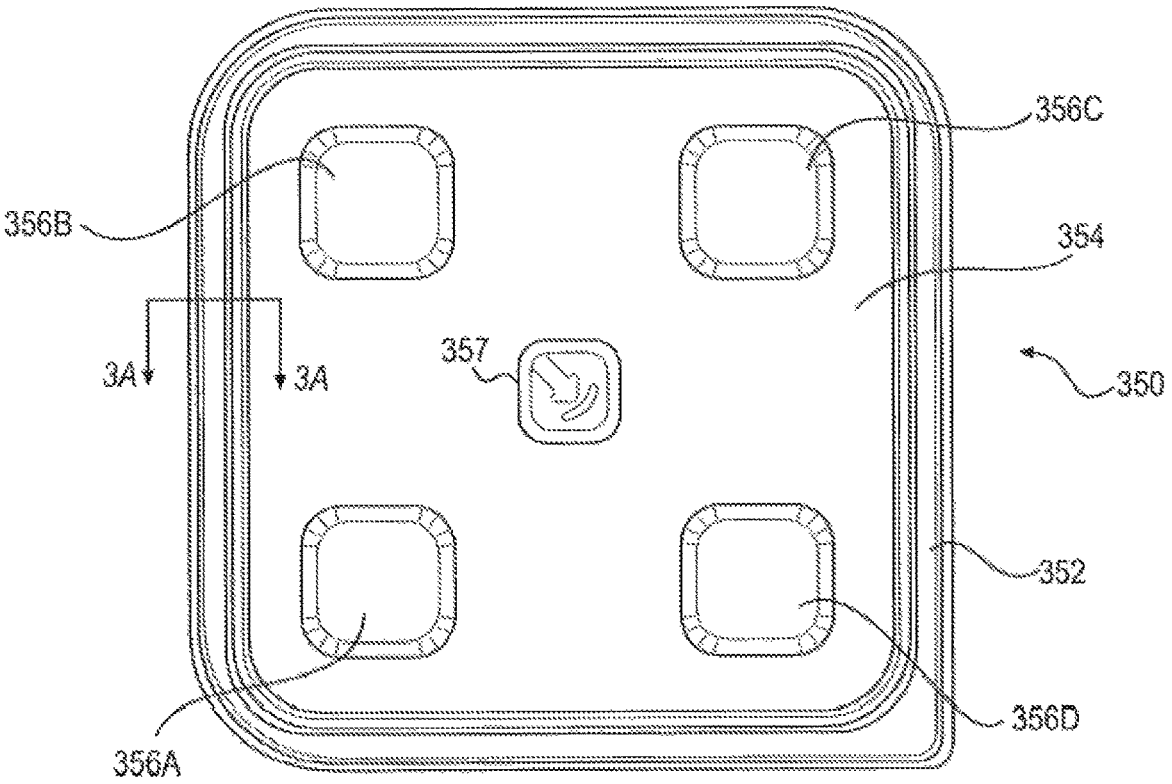
FIGS. 3A and 3B are views of one of the lids shown in FIG. 1.
Figure 3B:
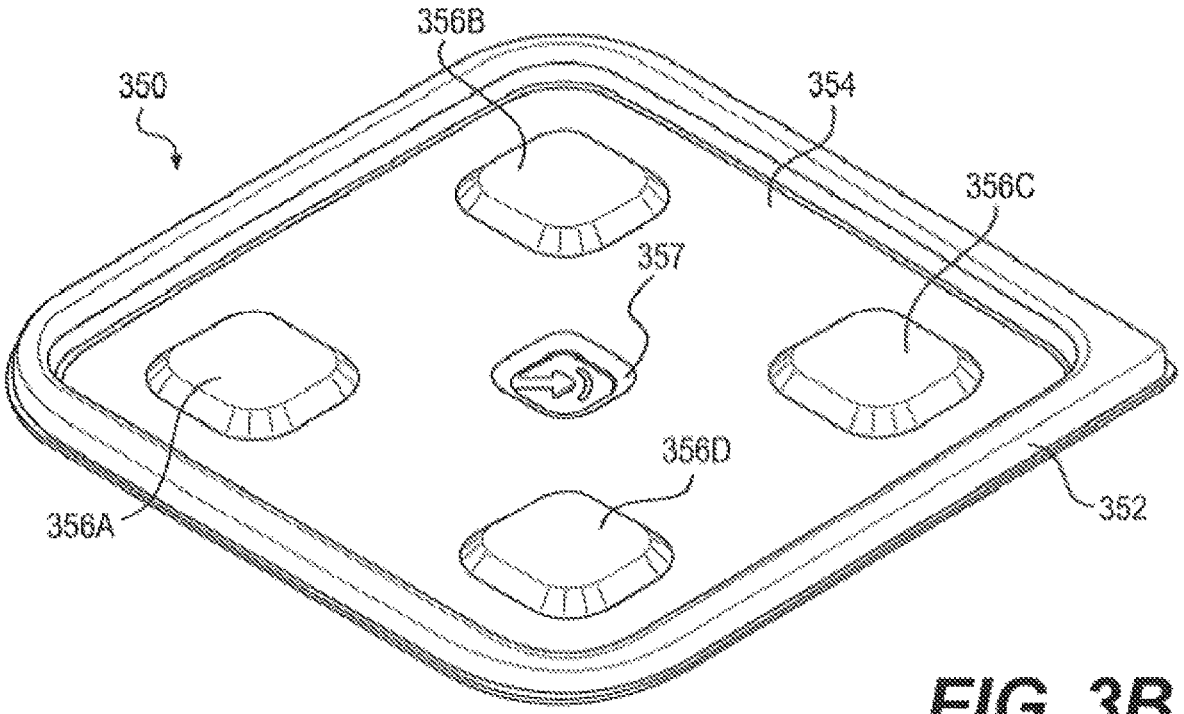

FIGS. 3A and 3B are views of the lid 350. The lid 350 includes a sealing rim 352 that surrounds a center region 354. The sealing rim 352 is configured to engage sealing rim 312 of the container 300. In the center region 354 are a plurality of registration bumps 356A, 356B, 356C, and 356D that extend above the surface of the center region 354. The registration bumps 356A, 356B, 356C, and 356D are configured to be associated with the indented region in the bottom wall of another container, as will be described in detail below. In the middle of the center region 354 is an indicator 357 for a position to be pressed when sealing the lid 350 on the container 300, as will also be described below. Although not shown in FIGS. 3A and 3B, the lid 350 may also include one or more tabs that extend from the sealing rim 312 in order to facilitate handling of the lid 302, and in particular, to facilitate removal of the lid 302 from the container 300.

The combinations of containers and lids 100, 200, 300, 400, and 500 can be manufactured using a wide variety of well-known techniques, including, for example, thermoforming, injection molding, or vacuum molding. Further, the container systems 100, 200, 300, 400, and 500 can be formed from a wide variety of well-known polymeric materials, including, for example, low density polyethylene (LDPE), high density polyethylene (LDPE), polystyrene, crystalline polyethylene terephthalate, amorphous polyethylene terephthalate, polyvinyl chloride, polycarbonate, and polypropylene, as well as combinations thereof. As will be appreciated by those skilled in the art, with such materials the combinations of containers and lids 100, 200, 300, 400, and 500 can be made in a wide range of transparencies and/or colors.

Figure 4:
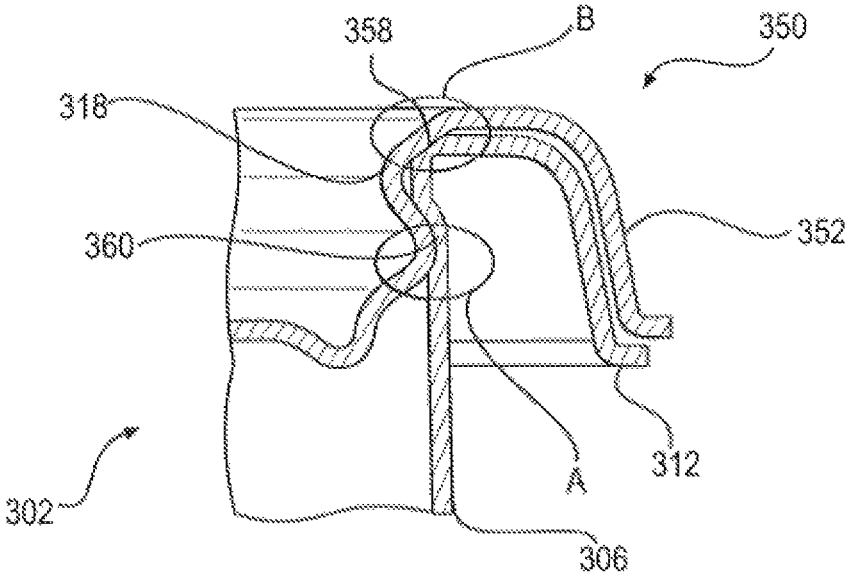
FIG. 4 is a cross-sectional view of a lid engaged to a container as taken along lines 2B-2B and 3A-3A in FIG. 2B and FIG. 3A, respectively.

FIG. 4 is a cross-sectional view of the lid 350 sealed to the container 302 according to an embodiment of the invention. Portions 358 and 360 of the sealing rim 352 of the lid 350 contact the rim 312 of the container 302 at regions A and B. The portions of the lid 350 other than the portions 358 and 360 are spaced from the container 302, including the portion of the lid 350 between the portions 358 and 360. Thus, a double seal is formed between the lid 350 and the container 302, with one seal at the region A on the inside of the container 302, and another seal at the region B on the top of the rim 312 of the container 302. Notably, the two sealing regions A and B are substantially aligned in the vertical direction such that the center of region B being directly above the center of region A. As such, the lid 350 may be effectively sealed to the container 302 so as to substantially prevent air from entering the container, and so as to prevent the contents of the container from escaping, e.g., preventing liquid from leaking out of the container 302. Additionally, the relative positioning of the sealing regions A and B facilitates the positioning and sealing of the lid 350 on the container 302.

Figure 5:
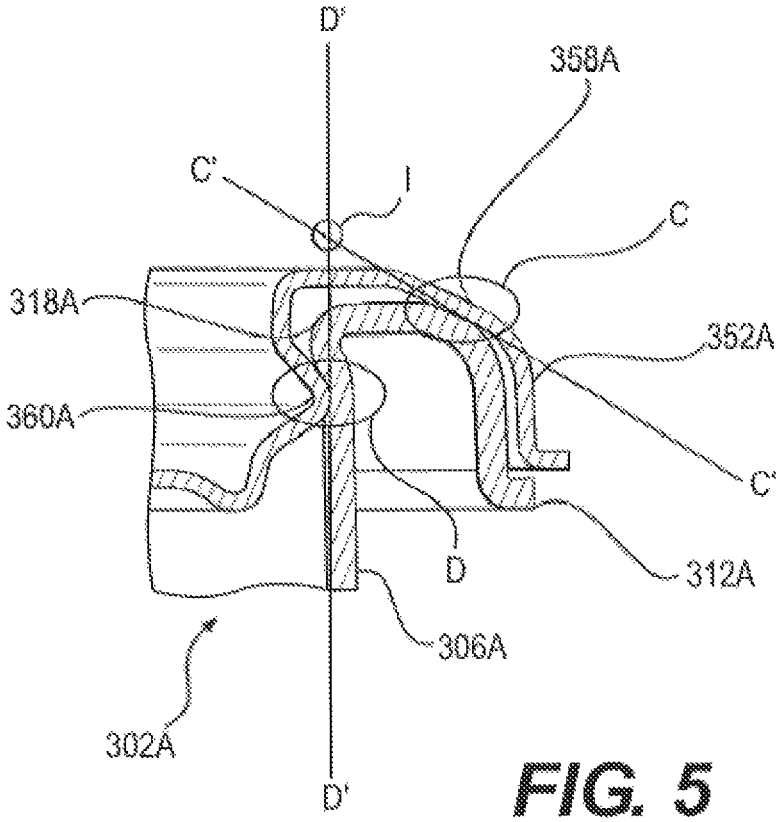
FIG. 5 is a cross-sectional view of a lid engaged to a container as taken along lines 2B-2B and 3A-3A in FIG. 2B and FIG. 3A, respectively.

FIG. 5 is a cross-sectional view of a lid 350A sealed to a container 302A according to an alternative embodiment of the invention. Portions 358A and 360A of the sealing rim 352A of the lid 350A contact the rim 312A of the container 302A at regions C and D. The portions of the lid 350A other than the portions 358A and 360A are spaced from the container 302A, including the portions of the lid 350A between the portions 358A and 360A. Thus, a double seal is formed between the lid 350A and the container 302A, with one seal at the region D on an outer portion of the rim 312A, and another seal at the region D on the inside of the container 302A. Notably, a tangent C' to the points of contact in the sealing region C intersects at a point I with a tangent D' to the points of contact in the sealing region D. The intersection point I lies above the container 302A, and within a projection of the extent of the sidewalls of the container 302A. The relative positioning of the sealing regions C and D, with tangents to the points of contact crossing above the container 302A, facilitates the positioning and sealing of the lid 350A on the container 302A.

It should be noted that either of the sealing configurations shown in FIGS. 4 and 5 could be used with any of the container systems according to our invention. That is, any of the container and lid combinations 100, 200, 300, 400, and 500 described above could be provided with the lid and container sealing configuration shown in FIG. 4. Alternatively, any of the combinations 100, 200, 300, 400, and 500 described above could be provided with the lid and container sealing configuration shown in FIG. 5.

The sealing configurations shown in FIGS. 4 and 5 provide a snapping sound that indicates to a user that the seals have been formed between the lids 350 and 350A and the containers 300 and 300A. The snapping sound occurs as a result of the sealing regions 360 and 360A being slightly compressed when they pass over the indented regions 318 and 318A of containers 350 and 350A. After reaching the bottom of the indented regions 318 and 318A, the sealing regions 360 and 360A decompress, which provides the snapping sound. With the sealing configurations shown in FIGS. 4 and 5, the snapping decompression of the sealing regions 360 and 360A occurs at about the same time as the sealing regions 358 and 358A make contact at regions A, B, C, and D with the respective portions of the sealing rims 312 and 312A. Thus, the snapping indicates to the user that the double seals have been formed. Notably, as is apparent from the foregoing description, the relative configurations of the rims 312 and 312A and the lids 350 and 350A can be made such that the lids 350 and 350A must be inserted into the containers 300 and 300A a certain amount before the sealing occurs. Thus, the configurations of the containers 300 and 300A and the lids 350 and 350A can be adjusted so that such a certain amount of force must be applied to the lids 350 and 350A in order to form the seals. In embodiments of the invention, the closing force required to form the seals, as applied at the center region of the lids 350 and 350A is generally about 2 lbs. to about 10 lbs.

As described above, the lids of container systems according to our invention may include an indicator that directs a user to push on a center portion of the lid when sealing the lid to a container. For example, the lid 350 is provided with an indicator 357 at the center of the region 354. When the lid 350 is set to the open top 310 of the container 300, the user is directed to press the lid 350 at the indicator 357 in order to effect the sealing operation. That is, by pressing the lid 350 at the indicator 357, the sealing rim 352 may be forced to seal against the rim 312 of the container 300 in the manner shown in FIGS. 4 and 5. Notably, the registration bumps 356 formed in the lid 300 provide an added rigidity to the lid 300. The added rigidity aids in the transfer of the force from the pressed indicator 357 at the center of the lid 350 out to the sealing rim 352. More specifically, because of the added rigidity from the registration bumps 356, the lid 350 may be sealed to the container 300 with a relatively small amount of force being applied at the indicator 357, and without the lid 350 being greatly deflected by the force applied at the indicator 357. It should be noted that the indicator 357 need not be a distinct physical structure on the lid 350, but rather may be, for example, a mark applied to the lid 350. It also be noted that in other embodiments, no indicator is provided on the lid, such in the lid 450 shown in FIG. 1D.

In order to demonstrate the rigidity added that is added to the lids by the registration bumps, the amount that the lids deflect when being sealed to containers was determined in a series of tests. Properties of the six Lids A-F that were tested are shown in TABLE 1.

TABLE 1

| Lid | Length (in.) | Width (in.) | Average Thickness (in.) | Number of Registration Bumps | Area of Registration Bumps ($in.^2$) | Height of Registration Bumps (in.) |
|---|---|---|---|---|---|---|
| A | 1.41 | 1.41 | 0.025 | 1 | 2.038 | 0.161 |
| B | 1.44 | 1.44 | 0.025 | 2 | 2.134 | 0.161 |
| C | 1.44 | 1.44 | 0.025 | 2 | 2.134 | 0.161 |
| D | 1.41 | 1.41 | 0.025 | 2 | 2.038 | 0.161 |
| E | 1.41 | 1.41 | 0.025 | 2 | 2.038 | 0.161 |
| F | 1.52 | 1.52 | 0.025 | 3 | 2.384 | 0.161 |

The deflection of Lids A-F was determined as the lids were sealed on corresponding containers. That is, the lids were pressed at a center portion so as to seal the lids on the corresponding container, with the amount that each of the lids moved downward being measured as "deflection." For lids B and C, the corresponding containers had the same lengths and widths (corresponding to lengths and widths of lids B and C), but different heights. Similarly, for lids D and E, the corresponding containers had the same lengths and widths (corresponding to lengths and widths of lids D and E), but different heights. All of the lids and containers had the same type of sealing structures. The tests were conducted five times for each of lids A-F, with the average deflection at peak force, the maximum deflection at peak force, and the minimum deflection at peak force being determined for each lid. The results of these tests are shown in TABLE 2. Also shown in TABLE 2 are the average, maximum, and minimum peak forces that were used in the test to seal the lids to the containers.

TABLE 2

| Lid | Average Deflection at Peak Force (in.) | Maximum Deflection at Peak Force (in.) | Minimum Deflection at Peak Force (in.) | Average Peak Force (lbs) | Maximum Peak Force (lbs) | Minimum Peak Force (lbs) |
|---|---|---|---|---|---|---|
| A | 0.168 | 0.234 | 0.045 | 1.735 | 2.900 | 0.500 |
| B | 0.257 | 0.374 | 0.054 | 6.989 | 12.252 | 0.756 |
| C | 0.417 | 0.632 | 0.190 | 7.633 | 12.372 | 1.256 |
| D | 0.288 | 0.381 | 0.129 | 4.035 | 5.820 | 1.200 |
| E | 0.364 | 0.469 | 0.206 | 7.700 | 11.060 | 2.720 |
| F | 0.413 | 0.509 | 0.196 | 5.787 | 8.060 | 1.720 |

Those skilled in the art will appreciate that the amount of deflection in the lids A-E is relatively small, and certainly smaller than corresponding lids having the same configuration without registration bumps. Along these lines, a further test was conducted where the stiffness of a lid having four registration bumps was compared to a lid of the same size without registration bumps. In this test, the two lids were subjected to vibrations at the same frequencies. The lid with the four registration bumps was found to vibrate in the same manner as the lid without registration bumps, but at about 28% higher frequencies for the same vibration. This indicates that the lid without registration bumps was much stiffer than the lid without registration bumps. Hence, the results of the vibration test are consistent with the results of the deflection tests in that the lid with the registration bumps demonstrated an added rigidity.

Figure 6A:
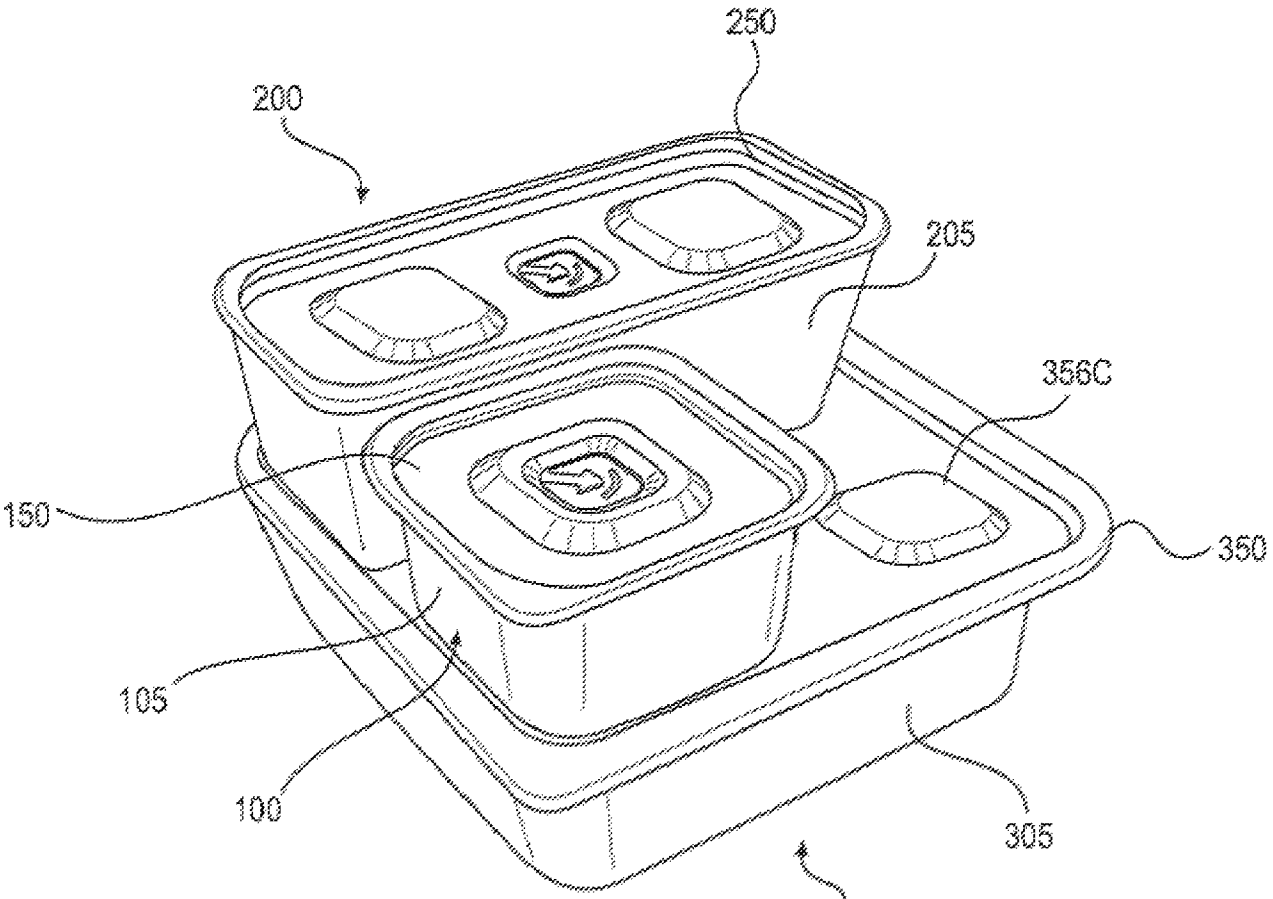
FIGS. 6A-6C are views of a container system according to an embodiment of our invention.
Figure 6B:
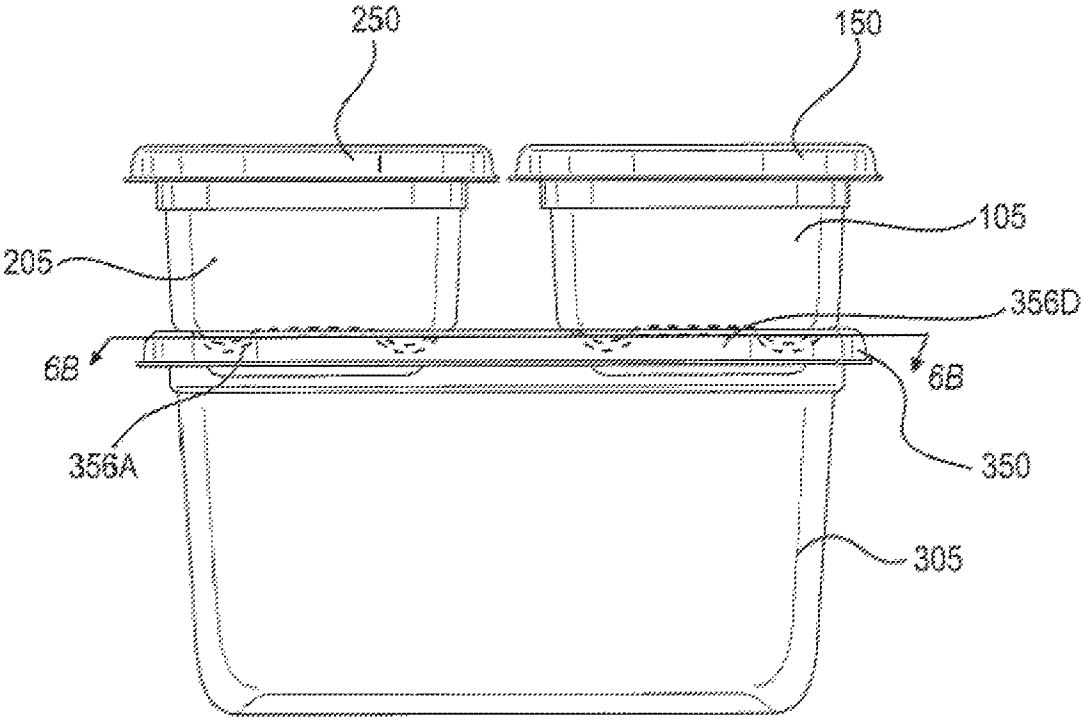
Figure 6C:
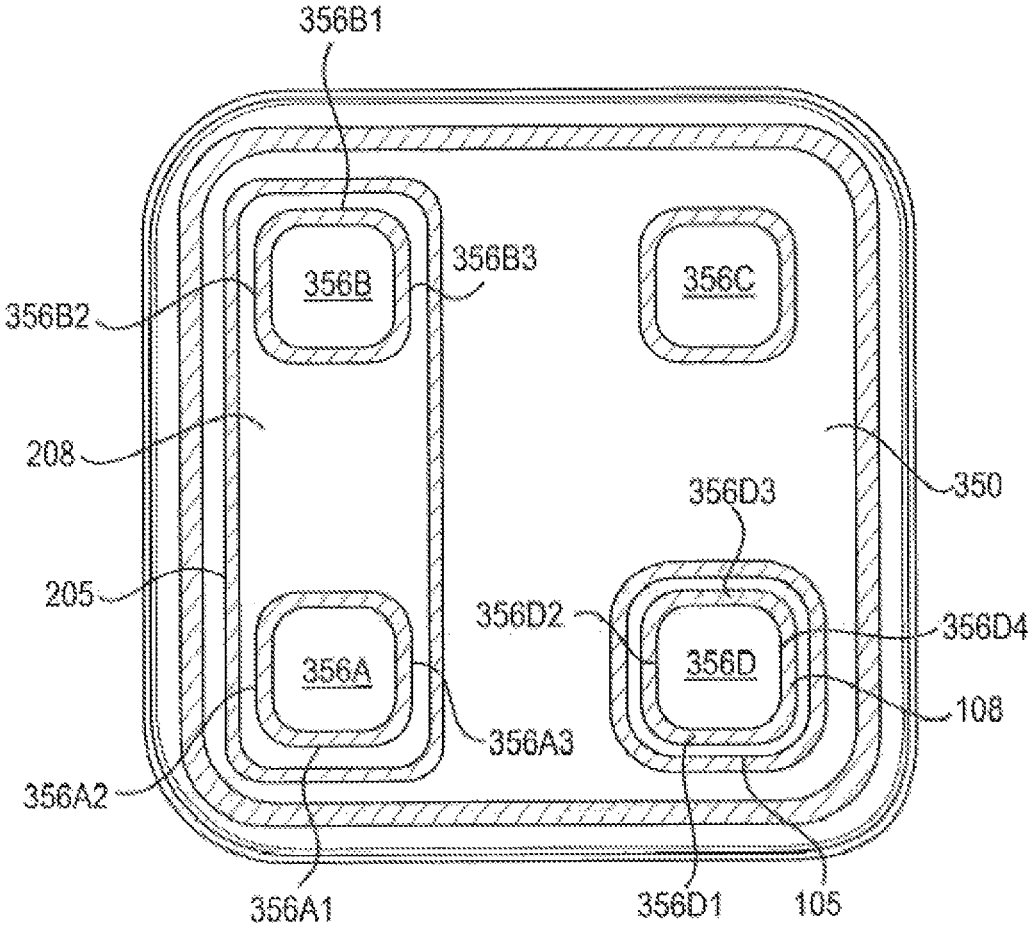

FIGS. 6A-6C are views of stacked container and lid combinations 100, 200, and 300. In this stacked configuration, the containers 102, 202, and 302 are sealed with lids 150, 250, and 350. The registration bumps 356A, 356B, 356C, and 356D on lid 350 are associated with indented recesses in the bottom walls of containers 102 and 202 so as to position the containers 102 and 202 on the lid 350, as will be described more fully below. Because of the modular nature of the container system, the differently-sized containers 102, 202, and 302 are stacked in a compact arrangement.

FIG. 6C is a cross-sectional view as seen through 6B-6B shown in FIG. 6B. As can be seen in FIG. 6C, the container 202 is positioned such that the two registration bumps 356A and 356B of lid 350 are located within the indented recess 208 in the bottom wall of the second container 202. The sides 356A1 and 356B1 of the registration bumps 356A and 356B are each located adjacent to different sides of the indented recess 208. The sides 356A2 and 356B2 of the registration bumps 356A and 356B are located adjacent to one of the sides of the indented recess, while the sides 356A3 and 356B3 are located adjacent to another of the sides of the indented recess 208. With the configurations of the indented recess 208 of the container 202 and the registration bumps 356A and 356B, the second container 200 is effectively located in a stacked position on the second lid 350.

As can also be seen in FIG. 6C, the container 102 is positioned by a single registration bump 356D on the lid 350. In this case, the length 1L and width 1W result in the container 102 being positioned such that each of the sides of the indented recess 108 in the bottom wall 104 are located adjacent to one of the sides 357D1, 357D2, 357D3, and 357D4 of the registration bump 356D.

Notably, the registration bumps 356A, 356B, 356C, and 356D do not "lock" against the bottom walls 104 and 204 of the containers 102 and 202. In fact, the registration bumps 356A, 356B, 356C, and 356D need not be in contact with any of the sides of the indented recesses 108 and 208 when the containers 102 and 202 are stacked on lid 350. The containers 102 and 202 are, therefore, easily positioned to and removed from the lid 350. Additionally, because the bottom walls 104 and 204 of containers 102 and 202 are merely positioned by the registration bumps 356 and not locked to the registration bumps 356, the indented recesses 108 and 208 may be relatively shallow. In other container systems, when a locking type engagement is formed between the lid of one container and the bottom of another container, an indented structure formed in the bottom of the container must extended substantially into the interior of the container. Further, the indented structure in other container system must often have an intricate shape in order to effectively lock to the lid of the other container. The deeper indented structures will often take up more space on the interior of the container, and the intricate shapes may be more difficult to form. On the other hand, the relatively shallow and simply shaped indented recesses in the container systems according to our invention do not take up a substantial amount of the inside of the containers and are relatively easy to form when manufacturing the containers.

Those skilled in the art will appreciate that the modular functionality demonstrated by the arrangements shown in FIGS. 6A and 6B will also be achieved with different arrangements and combinations of containers according to our invention. For example, containers 102 having a length 1L and a width 1W could be stacked on the lid 350 of the container 302 having a length 2L and a width 2W. As another example, the container 302 could be stacked on the lid 450 of the container 402 having a length 3L and a width 2W. In such a case, two containers 102 (with lengths 1L and widths 1W) could also be stacked, in addition to the container 302 on the lid 450 of the container 402.

It should also be apparent from the foregoing description that although embodiments of the invention are described with registration bumps being provided on the lids of the containers and corresponding recesses on the bottom of containers, in other embodiments the structures could be flipped such that registration bumps are provided on the bottoms of the container while recesses are provided in the lids. With such flipped arrangements, the lids and containers would stack in the same manner as described herein.

Figure 7:
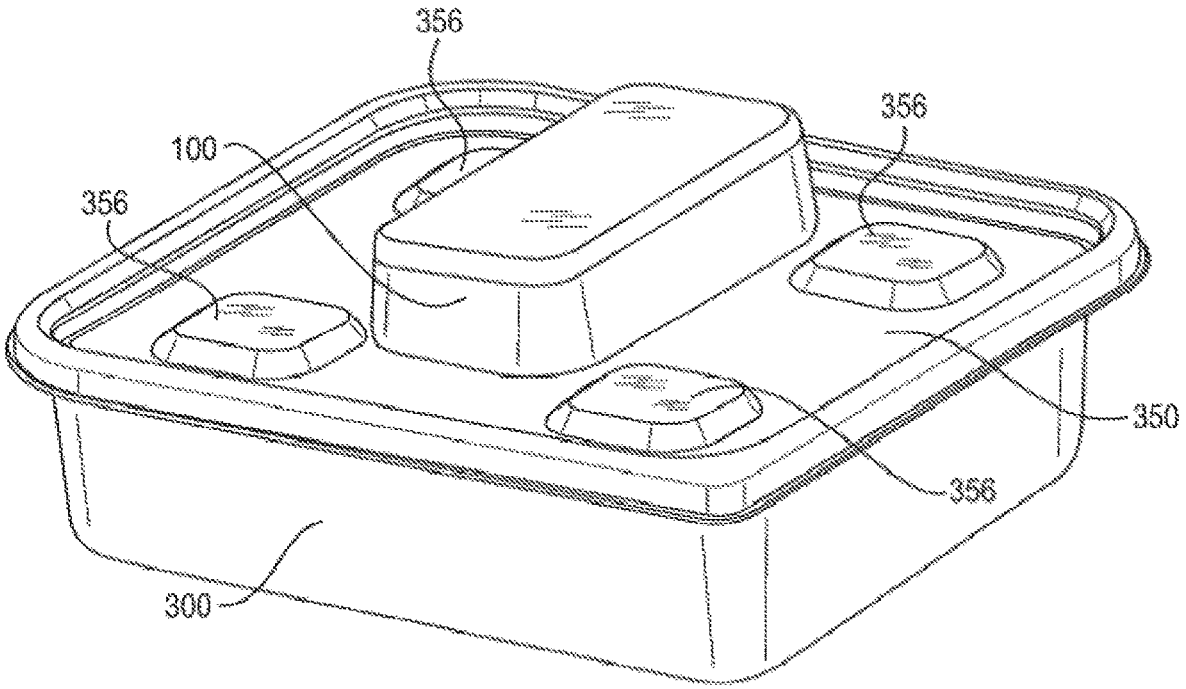
FIG. 7 is an elevation view of a container system according to another embodiment of our invention.

FIG. 7 shows an alternative stacking configuration according to our invention. In this embodiment, the container 102 is stacked on the lid 350 of the container 302. Unlike the embodiments described above, in the embodiment shown in FIG. 7, the container 102 is provided at a position between the registration bumps 356 on the lid 350. Note that this stacking configuration can be achieved with the containers 102 and 302 having the same configurations as described above. Thus, the containers 102 and 302 can alternatively be provided in the stacking configuration shown in FIGS. 6A-6C or the stacking configuration shown in FIG. 7.

As will be appreciated by those skilled in the art, in view of the stacking configurations shown in FIGS. 6A-6C and 7, the registration bumps that are formed on the lids of container systems according to our invention can be formed in a variety of shapes and sizes. In general, as long as the registration bumps provide at least one region that can be used to locate a portion of the indented regions on the bottom of a container, the registration bumps will function in the manner to provide for the stacking of containers, as described above. It follows that the registration bumps in embodiments of our invention could be, for example, provided in circular shapes, triangles, or any other polygonal shape. Moreover, there need not be a direct correspondence between the registration bumps and the indented regions on the bottom of the containers. For example, the registration bumps could be provided as post structures, with three such post structures being provided to locate the indented recess 108 in the bottom of the 1L length and 1W width container 105.

FIGS. 8D-8F are views of round containers 502A, 502B, and 502C being stacked on the lids 350A, 350B, and 350C of the containers 302A, 302B, and 302C, with the bottoms of the round containers 502A, 502B, and 502C being shown in FIGS. 8A-8C. Container 502A has a "doughnut" type shape 503A on its bottom surface. The outer edge of the doughnut shape 503A fits between the registration bumps on the lid 350A. The bottom surfaces of containers 502B and 502C have a plurality of recesses 503B and 503C, respectively. The recesses 503B and 503C are configured to register between the registration bumps on lids 350B and 350C. Thus, the round containers 502A, 502B, and 502C fit within the modularity of our inventive container systems inasmuch as the round containers may be included with stacking arrangements of the other shaped containers in our systems.

It should be noted that, while the stacking arrangements described above include two levels, i.e., one or more containers stacked on another container, the container systems according to our invention could have additional levels. For example, an embodiment includes a 1L length and 1W width container stacked on the lid of a 2L length and 2W width container and lid, with the stacked 2L length and 2W width container itself stacked on the lid of a 3L length and 2W width container. In a similar manner numerous multiple level arrangements can be formed with the inventive container systems. As one having ordinary skill in the art will readily appreciate, other variations are certainly contemplated within the scope of our invention.

Figure 9:
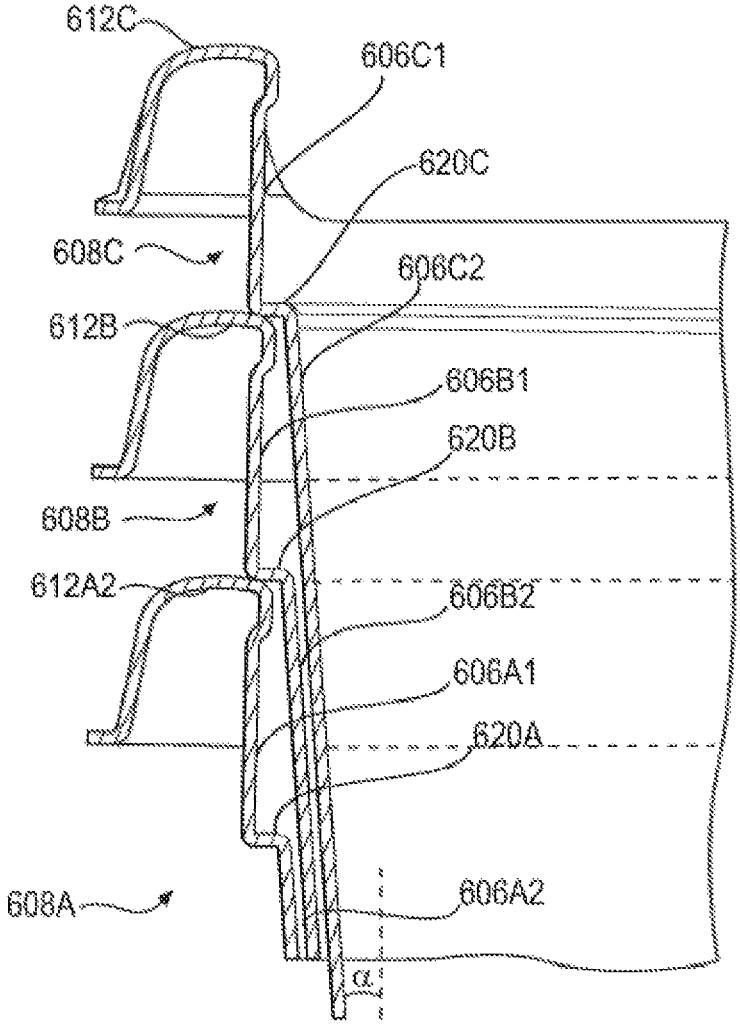
FIG. 9 is a cross-sectional view of nested containers according to an embodiment of our invention, with the view of each container as taken along line 2B-2B in FIG. 2B.

FIG. 9 is a cross-sectional view of a nested stack of containers 608A, 608B, and 608C according to an embodiment of our invention. In the nested stack, the containers 608A, 608B, and 608C are not sealed by lids. To facilitate the nesting of the containers 608A, 608B, and 608C, lugs 620A, 620B, and 620C are formed in the sidewalls of the containers 608A, 608B, and 608C. The lugs 620A, 620B, and 620C separate upper portions 606A1, 606B1, and 606C1 of the sidewalls and lower portions 606A2, 606B2, and 606C2 of the sidewalls. The lugs 620B and 620C contact to the top of the sealing rims 612A2 and 612B, respectively. In this manner, the container 608B is only nested to a certain depth within container 608A, and the container 608C is only nested to a certain depth within container 608B. Also, the angles at which the lower portions 606A2, 606B2, and 606C2 of the sidewalls extend from the lugs 620A, 620B, and 620C are such that the lower portions 606A2, 606B2, and 606C2 of the sidewalls of the nested containers 608A, 608B, and 608C do not contact each other. Because the containers 608A, 608B, and 608C are not deeply nested into each other, and because the lower portions 606A2, 606B2, and 606C2 of the sidewalls do not contact each other, the containers 608A, 608B, and 608C may easily be removed from the stack. That is, the configuration of the containers 608A, 608B, and 608C prevents the containers 608A, 608B, and 608C from becoming "stuck" together when nested, as shown in FIG. 9.

As shown in FIG. 8, the lower portions 606A2, 606B2, and 606C2 of the sidewalls may be set at an angle $\alpha$ set relative to the vertical. The angle can be set to achieve good stacking, space savings, as well as ease of manufacture. In embodiments of our invention, the angle $\alpha$ is between about 3° to about 8°. In more specific embodiments, the angle $\alpha$ is about 3.5° to about 6°, and in even more specific embodiments, the angle $\alpha$ is about 4° to about 5°.

Figure 10:
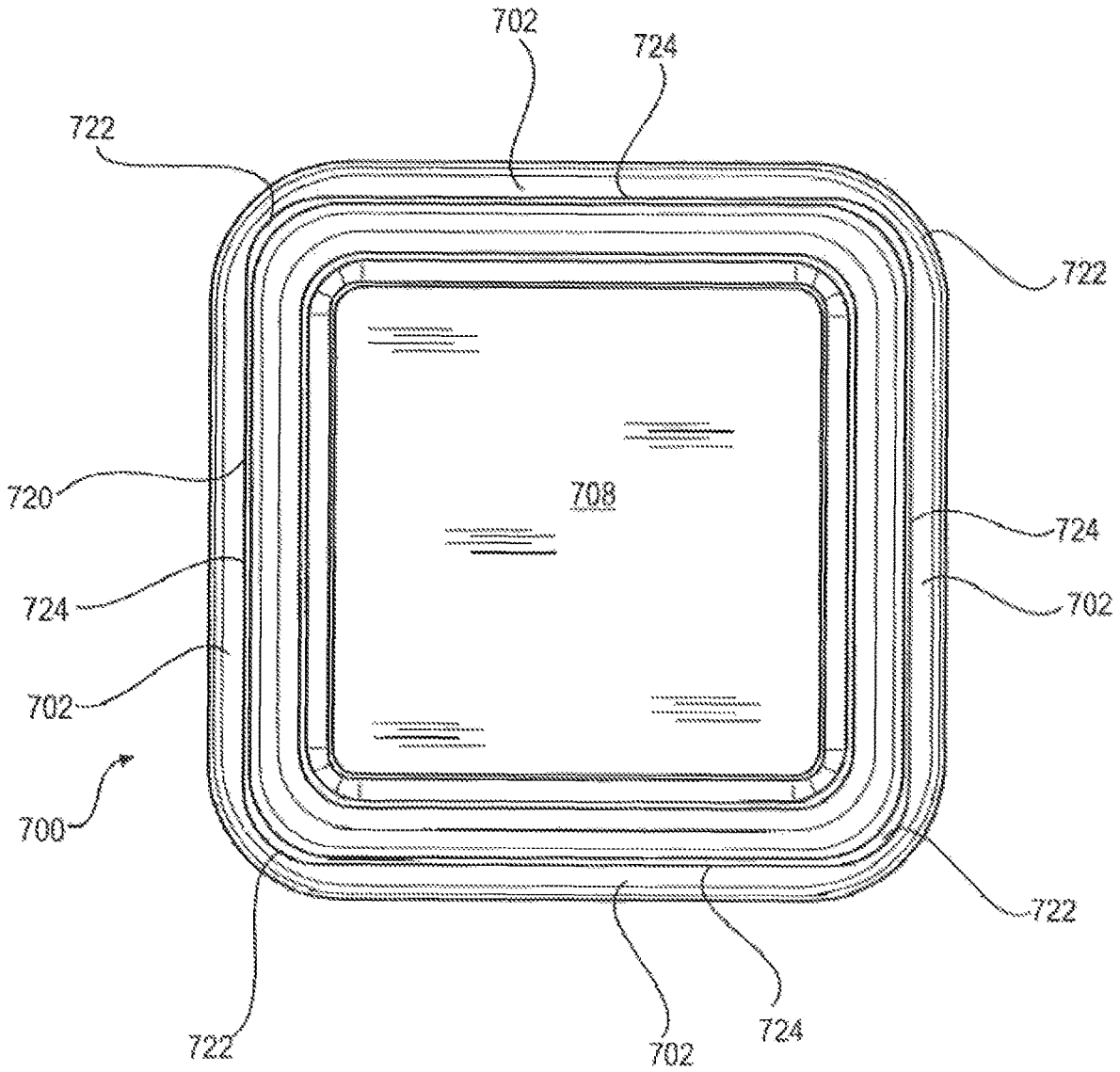
FIG. 10 is a bottom view of a container according to an embodiment of the invention.

FIG. 10 is a view of the bottom 708 of a container 700, wherein the lug 720 can be seen around the sides 702 of the container 700. The lug 720 includes portions 722 at the corners of the container 720, and portions 724 that extend along the sides of the container 700 between the corner portions 722. The corner portions 722 of the lug 720 are substantially wider than the portions 724 that extend along the sides of the container 700. The wider corner portions 722 help to prevent the container 700 from becoming stuck when the container 700 is nested with other containers, such as in a nested stack as described above.

Figure 11:
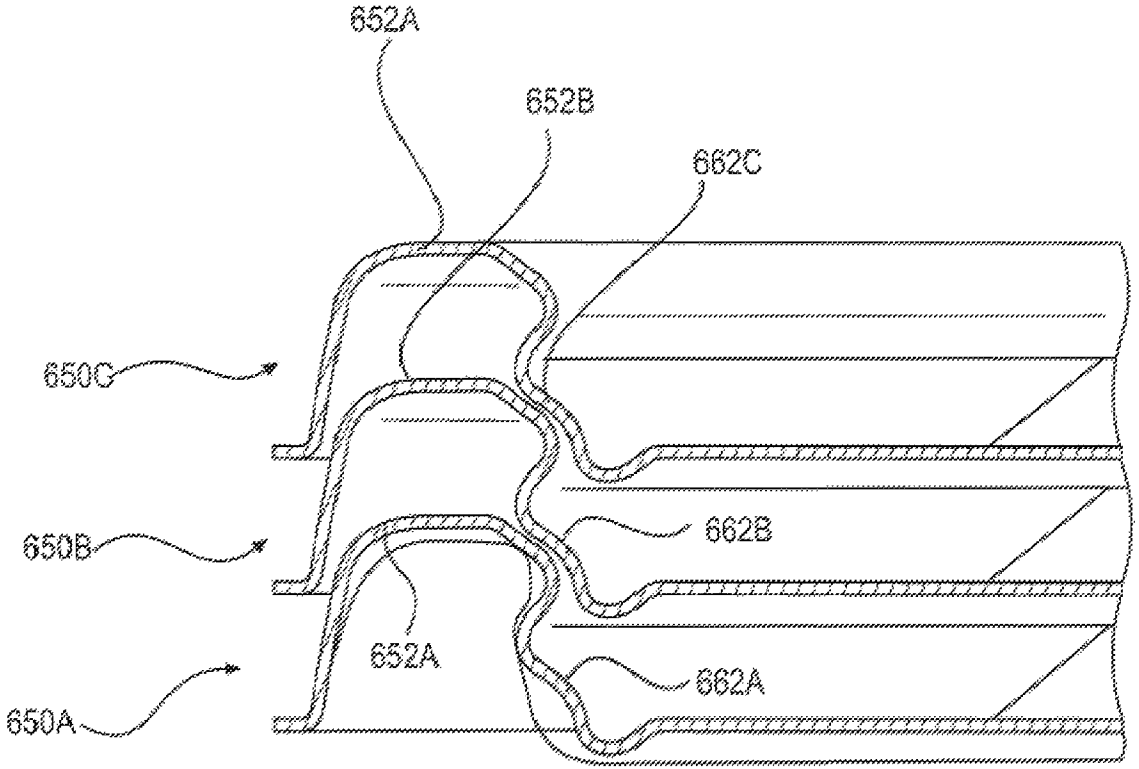
FIG. 11 is a cross-sectional view of nested lids according to an embodiment of our invention, with the view of each lid as taken along line 3A-3A in FIG. 3A.

FIG. 11 is a cross-sectional view of a nested stack of lids 650A, 650B, and 650C according to an embodiment of our invention. The lids 650A, 650B, and 650C include lugs 662A, 662B, and 662C for contacting an adjacent lid in the stack. More specifically, the lug 662B contacts a portion of the sealing ring 652A of lid 650A, and the lug 662C contacts a portion of the sealing ring 652B of lid 650B. Although not shown, the lug 662A could contact a sealing ring of another lid, and the lug of yet another lid could be made to contact the sealing ring 652C. The nested stack of lids 650A, 650B, and 650 is a compact and stable arrangement that can be utilized when the lids 650A, 650B, and 650 are separated from containers. Alternatively, the nested stack of lids 650A, 650B, and 650 could be positioned on the a nested stack of containers according to our invention, such as the nested stack of containers 608A, 608B, and 608C shown in FIG. 10. The combination of a nested stack of lids 650A, 650B, and 650C and nested containers 608A, 608B, and 608C allows for the container systems of our invention to be stored in a minimal amount of space when the container and lids are not being used.

Figure 12:
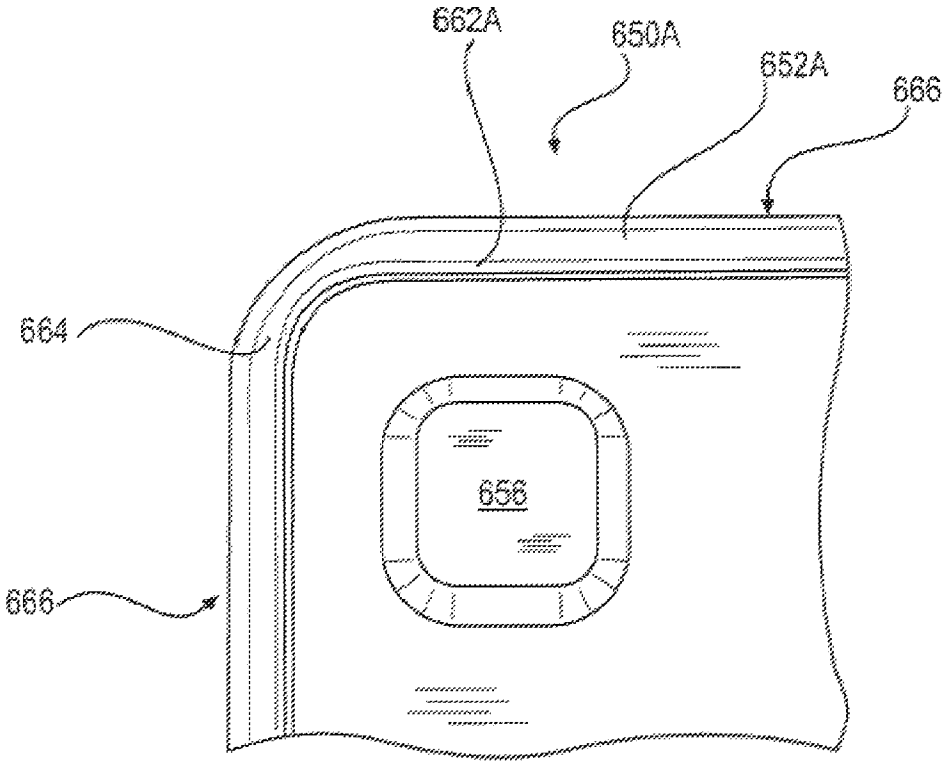
FIG. 12 is a top view of a corner of a lid according to an embodiment of our invention.

FIG. 12 shows a corner of a lid 650A adjacent to a registration bump 656 according to an embodiment of our invention. The stacking lug 662A and sealing rim 652A portion of the lid 650A are tighter at the corner 664 of the lid 650A than along other portions 666 along the stacking lug 662A and sealing rim 652A. That is, the sealing rim 652A does not extend as far out from the stacking lug 662A at the corners 664 as at the other portions 666 along the lid 650A. The tighter corner 664 of the lid 650A helps to prevent the lid 650A from getting stuck to other lids when nested in a stack, such as the nested stack of lids 650A, 650B, and 650C shown in FIG. 11. One or more of the other corners (not shown) of the lid 650A could also have the tighter configuration to further help to be prevent the lid 650 from becoming stuck together with other lids in a nested stack.

As will be appreciated by those skilled in the art in view of the foregoing description, the container systems according to embodiments of our invention have numerous advantageous over other container systems. The inventive container systems may include a plurality of differently sized containers that can be stacked into highly compact arrangements. The compactly stacked arrangements are well-suited for confined spaces, such as refrigerators and cupboards. The lids for the container systems provide effective seals to the containers. At the same time, it easy for a user to seal the containers with the lids. When the containers are not sealed with the lids, the containers may be nested together, and the lids may be nested together, so as to take up a minimal amount of space. Further, the nested containers and nested lids do not become stuck together, and can therefore be easily separated.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of our invention to be determined by any claims supportable by this application and the equivalents thereof, rather than by the foregoing description.

INDUSTRIAL APPLICABILITY

The invention described herein can be used in the commercial production of plastic storage container systems. Such container systems have a wide variety of uses in homes and other locations, including the storage of food and other products.

We claim:

1. A container system comprising:
(A) a first container having a bottom wall, at least one sidewall, and an open top;
(B) a first lid for sealing the open top of the first container, the first lid including:
(a) a center portion; and
(b) a sealing rim provided about the center portion, with the sealing rim including:
(i) a first portion extending from the center portion in an outward direction and in an upward direction;
(ii) a second portion extending from the first portion in an inward direction and in the upward direction;
(iii) a third portion extending from the second portion in the outward direction and in the upward direction, wherein an extent of the third portion is further in the outward direction than a furthest extent of the first portion in the outward direction; and
(iv) a fourth portion extending from the third portion in the outward direction;
(C) a second container having a bottom wall, at least one sidewall, and an open top; and
(D) a second lid for sealing the open top of the second container, the second lid including:
(a) a center portion, and
(b) a sealing rim provided about the center portion, with the sealing rim including:
(i) a first portion extending from the center portion in an outward direction and in an upward direction;
(ii) a second portion extending from the first portion in an inward direction and in the upward direction;
(iii) a third portion extending from the second portion in the outward direction and in the upward direction, wherein an extent of the third portion is further in the outward direction than a furthest extent of the first portion in the outward direction; and
(iv) a fourth portion extending from the third portion in the outward direction,
wherein the first lid is configured to nest with the second lid such that (i) the first portion of the first lid contacts the third portion of the second lid and (ii) the fourth portion of the first lid is spaced from the fourth portion of the second lid.

2. The container system according to claim 1, wherein a part of the fourth portion of the sealing rim of the first lid is curved, and
wherein a part of the fourth portion of the sealing rim of the second lid is curved.

3. The container system according to claim 2, wherein the sealing rim of the first lid includes a fifth portion extending from the fourth portion in the outward direction, and the sealing rim of the second lid includes a fifth portion extending from the fourth portion in the outward direction.

4. The container system according to claim 3, wherein, when the first lid is nested with the second lid, the fifth portion of the first lid is spaced from the fifth portion of the second lid.

5. The container system according to claim 1, wherein the first portion of the first lid and the third portion of the first lid extend along parallel lines, and the first portion of the second lid and the third portion of the second lid extend along parallel lines.

6. The container system according to claim 1, further comprising:
a third container having a bottom wall, at least one sidewall, and an open top;
a third lid for sealing the open top of the third container, the third lid including:
(a) a center portion, and
(b) a sealing rim provided about the center portion, with the sealing rim including:
(i) a first portion extending from the center portion in an outward direction and in an upward direction;

(ii) a second portion extending from the first portion in an inward direction and in the upward direction;

(iii) a third portion extending from the second portion in the outward direction and in the upward direction, wherein an extent of the third portion is further in the outward direction than a furthest extent of the first portion in the outward direction; and (iv) a fourth portion extending from the third portion in the outward direction, wherein the third lid is configured to nest with the first lid such that (i) the first portion of the third lid contacts the third portion of the first lid and (ii) the fourth portion of the third lid is spaced from the fourth portion of the fourth lid.

7. The container system according to claim 1, wherein the first container has one of a rectangular shape and a circular shape, and the second container has the same shape as that of the first container.

8. A container system comprising:

(A) a first container having a bottom wall, at least one sidewall, and an open top;

(B) a first lid for sealing the open top of the first container, the first lid including:

(a) a center portion, with a part of the center portion extending along a line; and (b) a sealing rim provided about the center portion, with the sealing rim including:

(i) a first portion extending from the center portion in an outward direction and in an upward direction;

(ii) a second portion extending from the first portion in an inward direction and in the upward direction;

(iii) a third portion extending from the second portion in the outward direction and in the upward direction; and (iv) a fourth portion extending from the third portion in the outward direction, wherein a part of the fourth portion extends along a line that is parallel to the line along the part of the center portion;

(C) a second container having a bottom wall, at least one sidewall, and an open top; and (D) a second lid for sealing the open top of the second container, the second lid including:

(a) a center portion, with a part of the center portion extending along a line; and (b) a sealing rim provided about the center portion, with the sealing rim including:

(i) a first portion extending from the center portion in an outward direction and in an upward direction;

(ii) a second portion extending from the first portion in an inward direction and in the upward direction;

(iii) a third portion extending from the second portion in the outward direction and in the upward direction; and (iv) a fourth portion extending from the third portion in the outward direction, wherein a part of the fourth portion extends along a line that is parallel to the line along the part of the center portion, wherein the first lid is configured to nest with the second lid such that (i) the first portion of the first lid contacts the third portion of the second lid and (ii) the fourth portion of the first lid is spaced from the fourth portion of the second lid.

9. The container system according to claim 8, wherein a part of the fourth portion of the sealing rim of the first lid is curved, and a part of the fourth portion of the sealing rim of the second lid is curved.

10. The container system according to claim 9, wherein the sealing rim of the first lid includes a fifth portion extending from the fourth portion in the outward direction, and the sealing rim of the second lid includes a fifth portion extending from the fourth portion in the outward direction.

11. The container system according to claim 10, wherein, when the first lid is nested with the second lid, the fifth portion of the first lid is spaced from the fifth portion of the second lid.

12. The container system according to claim 8, wherein the first portion of the first lid and the third portion of the first lid extend along parallel lines, and the first portion of the second lid and the third portion of the second lid extend along parallel lines.

13. The container system according to claim 8, further comprising:

a third container having a bottom wall, at least one sidewall, and an open top;

a third lid for sealing the open top of the third container, the third lid including:

(a) a center portion, with a part of the center portion extending along a line, and (b) a sealing rim provided about the center portion, with the sealing rim including:

(i) a first portion extending from the center portion in an outward direction and in an upward direction;

(ii) a second portion extending from the first portion in an inward direction and in the upward direction;

(iii) a third portion extending from the second portion in the outward direction and in the upward direction; and (iv) a fourth portion extending from the third portion in the outward direction, wherein a part of the fourth portion extends along a line that is parallel to the line along the part of the center portion, wherein the third lid is configured to nest with the first lid such that (i) the first portion of the third lid contacts the third portion of the first lid and (ii) the fourth portion of the third lid is spaced from the fourth portion of the fourth lid.

14. The container system according to claim 8, wherein the first container has one of a rectangular shape and a circular shape, and the second container has the same shape as that of the first container.

* * * * *